US011072933B2

(12) United States Patent
Brodowski et al.

(10) Patent No.: US 11,072,933 B2
(45) Date of Patent: Jul. 27, 2021

(54) PANEL PRODUCTION KITS, METHODS, AND SYSTEMS

(71) Applicant: Inventure Civil, LLC, Wake Forest, NC (US)

(72) Inventors: David M. Brodowski, Dayton, OH (US); Timothy J. Brereton, Rolesville, NC (US)

(73) Assignee: ASHGROVE HOLDINGS, INC., Sterling, VA (US)

( * ) Notice: Subject to any disclaimer, the term of this patent is extended or adjusted under 35 U.S.C. 154(b) by 719 days.

(21) Appl. No.: 15/442,035

(22) Filed: Feb. 24, 2017

(65) Prior Publication Data

US 2017/0247891 A1 Aug. 31, 2017

Related U.S. Application Data

(60) Provisional application No. 62/300,499, filed on Feb. 26, 2016.

(51) Int. Cl.
*E04G 11/08* (2006.01)
*E02D 29/02* (2006.01)

(52) U.S. Cl.
CPC ..... *E04G 11/08* (2013.01); *E02D 29/02* (2013.01); *E02D 2300/002* (2013.01); *E02D 2300/0029* (2013.01)

(58) Field of Classification Search
CPC ..... E04G 11/08; E04G 11/12; E02D 29/02; E02D 2300/002; E02D 2300/0029; B28B 7/34; B28B 7/08
See application file for complete search history.

(56) References Cited

U.S. PATENT DOCUMENTS 1,202,269 A * 10/1916 Cramer ..... E01C 19/506 249/8
2,886,876 A * 5/1959 Wilson ..... B28B 7/0017 249/13
2,979,801 A * 4/1961 Gasmire ..... B28B 23/024 264/278
4,228,985 A * 10/1980 Gaudelli ..... B28B 7/08 249/120
5,332,191 A * 7/1994 Nolan ..... B28B 7/0073 249/1

(Continued)

FOREIGN PATENT DOCUMENTS

WO WO-03058008 A1 * 7/2003 ..... B28B 7/0014

*Primary Examiner* — Leith S Shafi
(74) *Attorney, Agent, or Firm* — Bookoff McAndrews, PPLC

(57) ABSTRACT

A method of forming a concrete panel that includes forming a concrete base with a plurality of holes, where the plurality of holes are distributed proximate to a perimeter of a casting surface of the concrete base, and securing casting rails along the casting surface of the concrete base to form a concrete panel form with a closed perimeter. The casting rails are secured using a plurality of anchors through the plurality of holes in the concrete base to couple the casting rails to the concrete base. A reinforcement device and/or an attachment device is introduced within the concrete panel form, and concrete is poured into the concrete panel form. After the poured concrete has solidified into a concrete panel, the concrete panel is removed.

19 Claims, 21 Drawing Sheets

(56) References Cited

U.S. PATENT DOCUMENTS

| | | | | |
|---|---|---|---|---|
| 6,247,677 | B1 * | 6/2001 | Vinet | B28B 7/0014 249/189 |
| 7,877,889 | B2 * | 2/2011 | Griffin, Jr. | E04G 21/185 249/155 |
| 2003/0155683 | A1 * | 8/2003 | Pietrobon | E04G 13/00 264/130 |
| 2007/0276526 | A1 * | 11/2007 | Swanson | B28B 7/0014 700/95 |

* cited by examiner

PANEL PRODUCTION KITS, METHODS, AND SYSTEMS

CROSS-REFERENCE TO RELATED APPLICATION(S)

This application claims the benefit of U.S. Provisional Patent Application Ser. No. 62/300,499, filed Feb. 26, 2016, which is hereby incorporated by reference in its entirety.

TECHNICAL FIELD

Various aspects of the present disclosure relate generally to panel production kits, methods, and systems. More specifically, the present disclosure relates to the production of mechanically stabilized earth panels.

BACKGROUND

Steel rails and steel casting beds may be used to form mechanically stabilized earth panels (or "MSE panels") out of concrete. The process of casting an MSE panel typically involves assembling a steel form, placing the concrete in the form, curing the concrete to make a concrete panel, and removing the concrete panel from the steel form. The steel form is then cleaned and set up for the next pour. Only one panel is produced each day, typically, due to the time it takes to set up the form and cure the concrete. Further improvements are desired to increase production speed.

The steel form is heavy and cumbersome. Thus, in addition to being time-consuming, the process of setup, cleaning, and resetting the steel form may be difficult to do safely. Still further improvements are desired to improve safety.

Lastly, due to the wear and tear of setup, cleaning, and resetting the steel forms with known methods, the steel forms often need to be rehabilitated or replaced after a period of time. For example, the steel can become bent or pitted, or certain connection parts can fail. Even further improvements are desired to increase longevity.

DESCRIPTION

Figure 1:
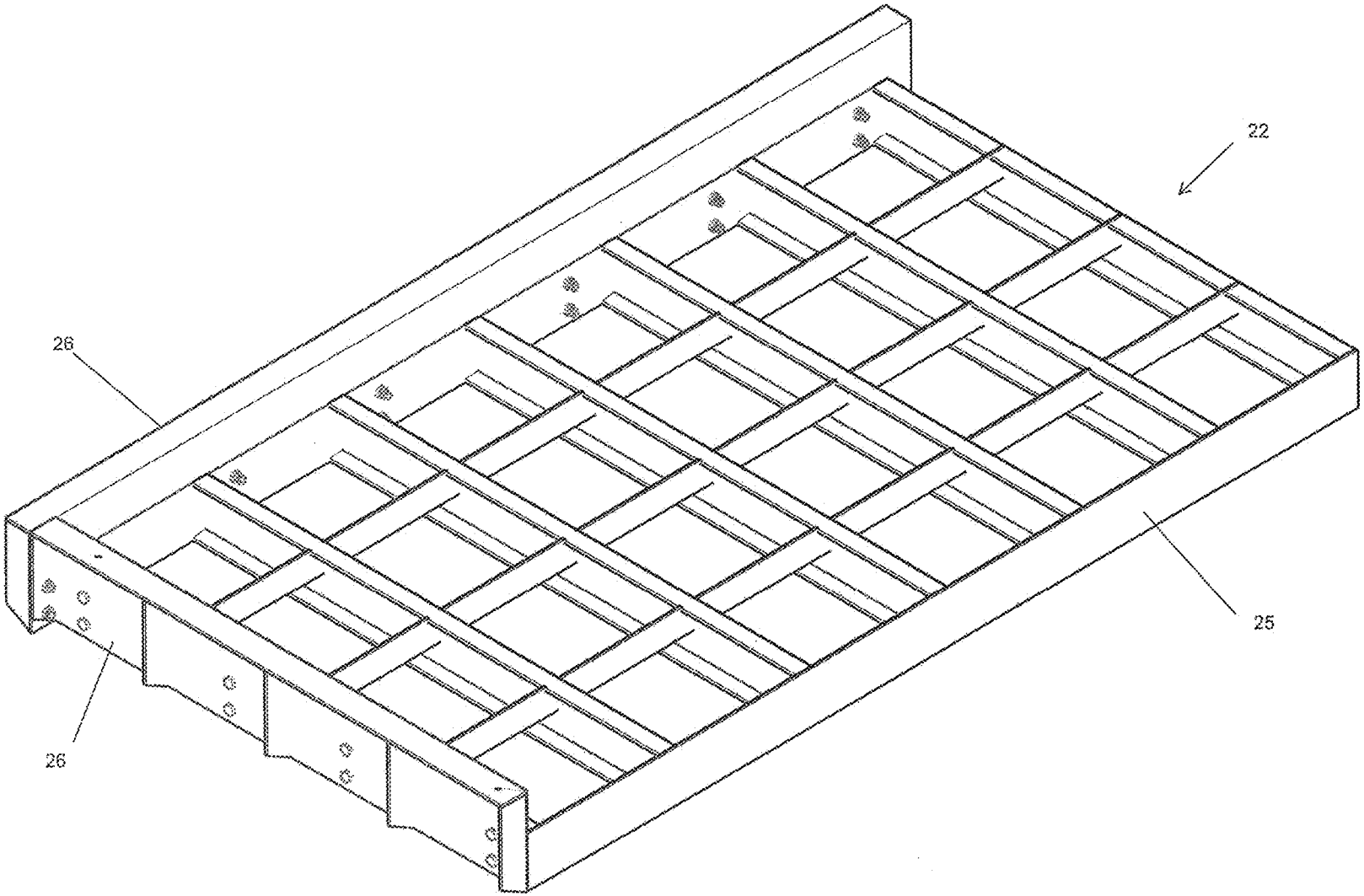
FIG. 1 illustrates a perspective view of a portion of a base casting form, according to an aspect of this disclosure.

The present disclosure is now described with reference to exemplary aspects of panel production kits, methods, and systems. Some embodiments are depicted and/or described with reference to the production of MSE panels out of concrete. These references are provided for convenience and are not intended to limit the present disclosure unless incorporated into the appended claims. Accordingly, the concepts and novelty underlying each embodiment may be utilized for any type of panel, made out of any material.

As used herein, the terms "comprises," "comprising," or any other variation thereof, are intended to cover a non-exclusive inclusion, such that a process, method, article, or apparatus that comprises a list of elements does not include only those elements, but may include other elements not expressly listed or inherent to such process, method, article, or apparatus. Unless stated otherwise, the term "exemplary" is used in the sense of "example," rather than "ideal." As used herein, the terms "about," "substantially," and "approximately," indicate a range of values within +/−5% of a stated value.

Exemplary aspects of the present disclosure are illustrated in FIGS. 1-16 attached hereto. One aspect is a kit, method, and/or system comprising a base casting form 22 (e.g., FIGS. 1-7) for making a concrete casting base 10 (e.g., FIG. 8), and a plurality of casting rails 30 (e.g., FIGS. 9-16) for mounting to concrete casting base 10 to define a concrete panel form 32 (e.g., FIG. 10) for making a concrete panel 12 (e.g., FIG. 16). The base casting form 22 may be used to make the concrete casting base 10. The plurality of casting rails 30 may be mounted to the concrete casting base 10, with the casting rails 30 defining the concrete panel form 32. Concrete may then be poured into the concrete panel form 32. Once hardened, the poured concrete forms concrete panel 12, which may be removed from the concrete panel form 32 and implemented as an MSE panel. Additional concrete panels 12 may then be formed with the concrete panel form 32. Similarly, additional concrete panel forms 32, including additional concrete casting bases 10 and casting rails 30, may be formed with the original base casting form 22. Therefore, one base casting form 22 may be used to form multiple concrete casting bases 10, and each concrete casting base 10 may then be used to form multiple concrete panels 12.

The kit and/or system may include a plurality of hardware (e.g., FIGS. 11-16) for implementing into rails 30 and/or concrete panel form 32 to improve the concrete panel 12 formed therein, or the speed of producing the same. Thus, in general, the present disclosure is directed to both (1) a base casting form 22 and related hardware for casting a concrete casting base 10; and (2) a plurality of casting rails 30 and related hardware for casting a concrete panel 12 on the concrete casting base 10. Additional hardware is disclosed for removably attaching the plurality of casting rails 30 to concrete casting base 10, for moving each rail 30 relative to base 10, and for automating the production of panels 12.

Figure 2:
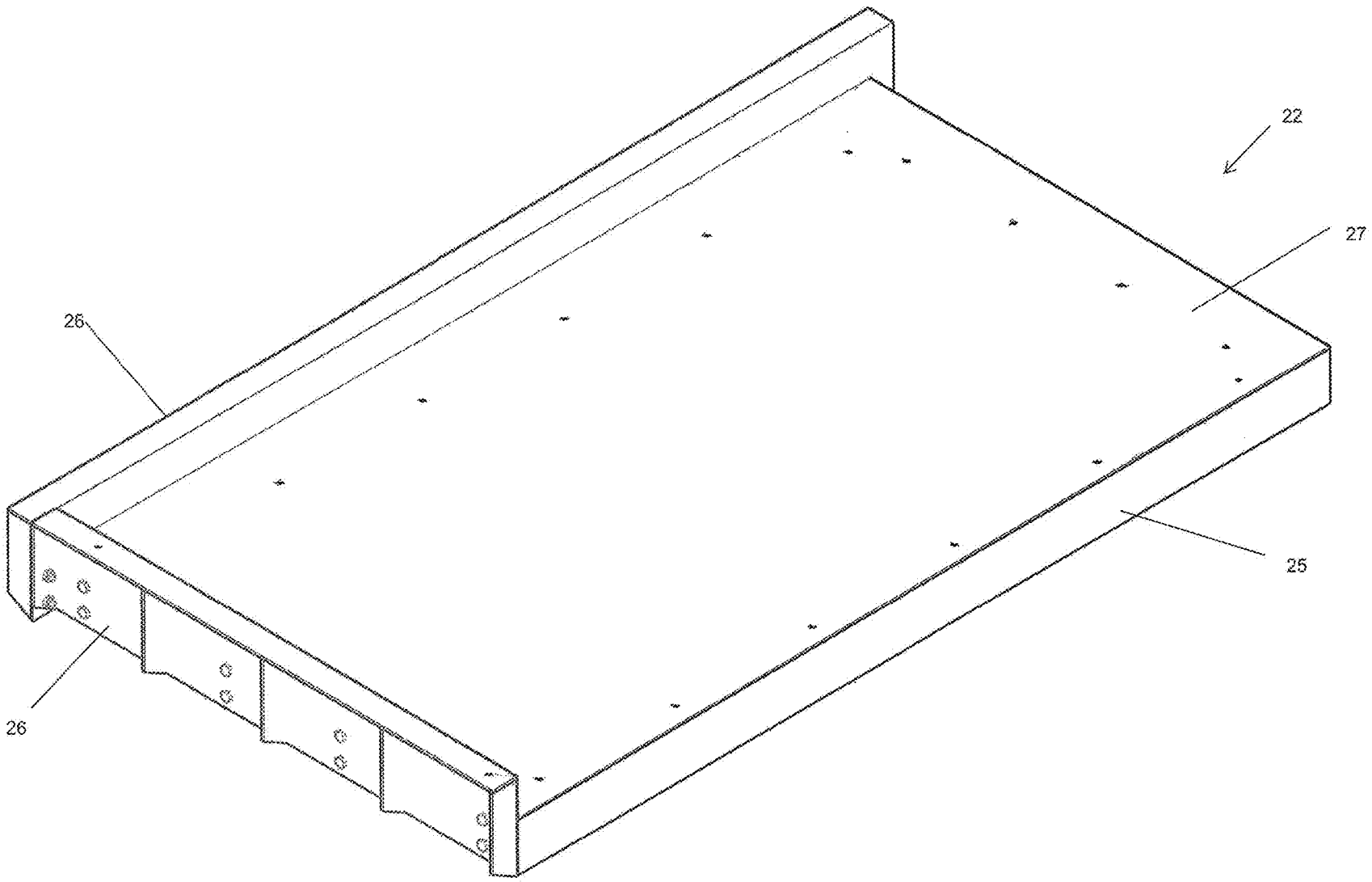
FIG. 2 illustrates a perspective view of an additional portion of a base casting form, according to an aspect of this disclosure.
Figure 3:
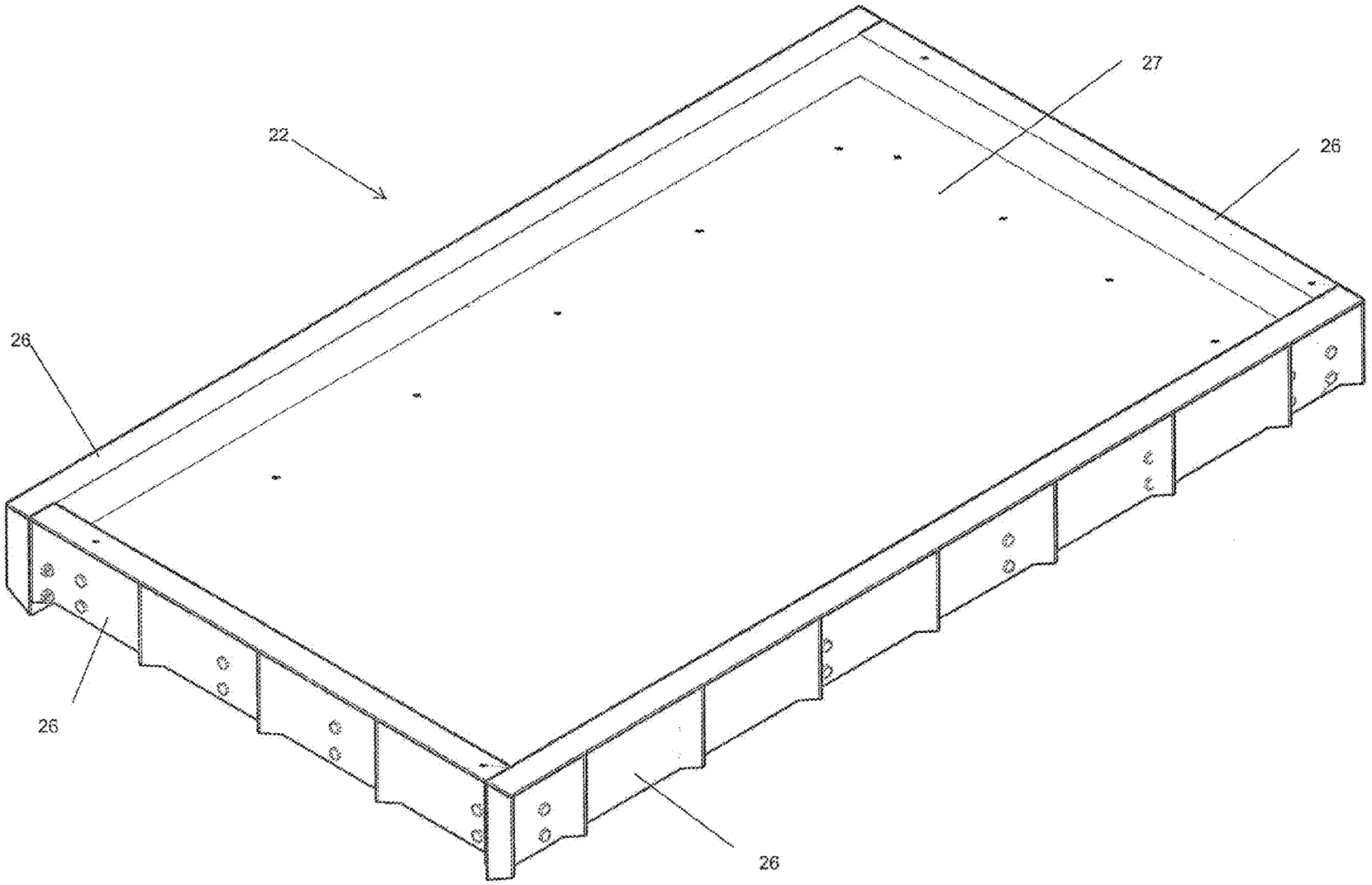
FIG. 3 illustrates a perspective view of a base casting form, according to an aspect of this disclosure.
Figure 4:
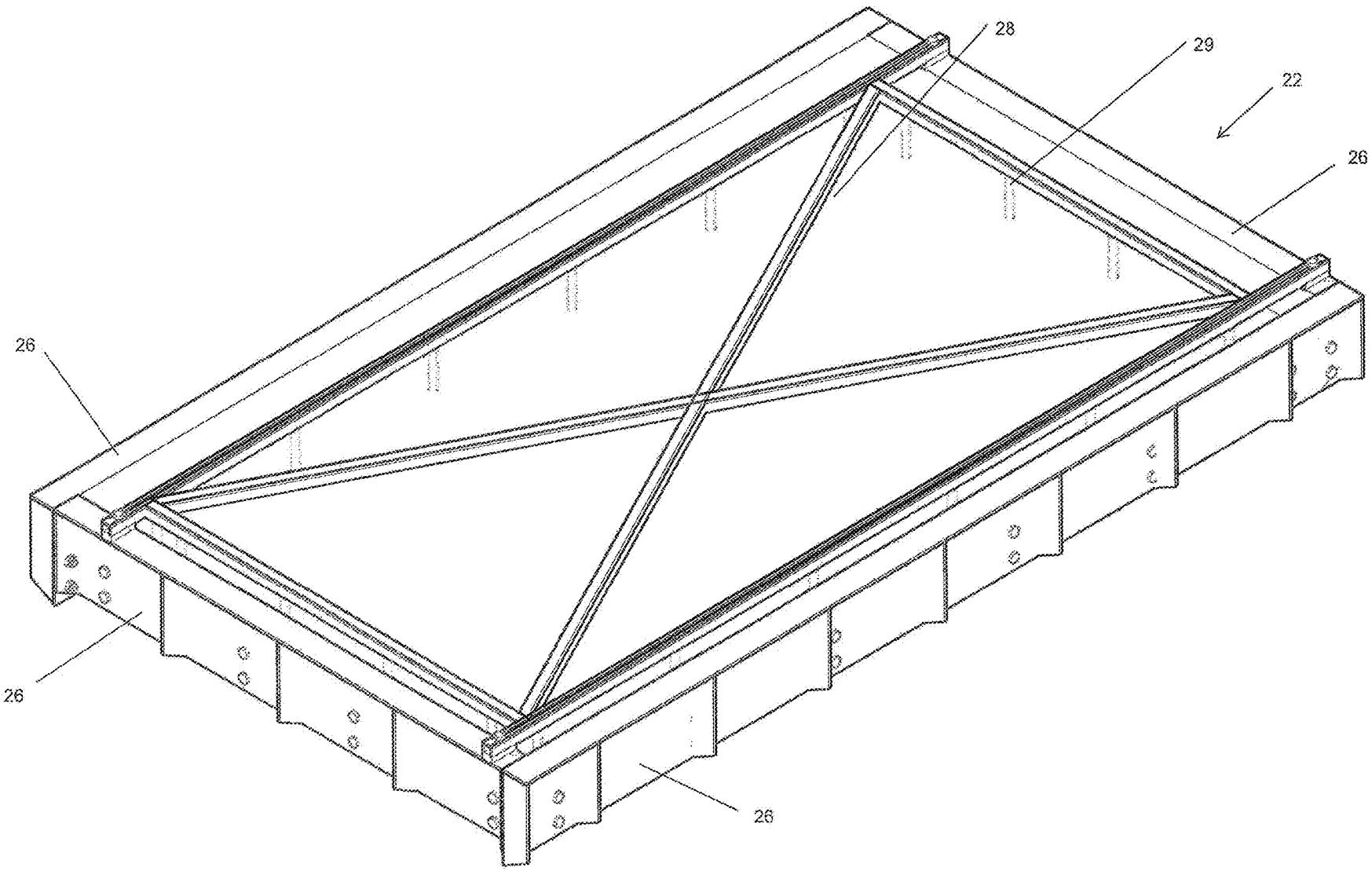
FIG. 4 illustrates a perspective view of a base casting form with a suspended framework attached, according to an aspect of this disclosure.

Referring now to the figures individually, FIG. 1 depicts a concrete base casting form 22 having a portion of its side walls 26 and the entirety of its casting surface skin 27 (FIG. 2) removed to expose a steel frame 25. FIG. 2 depicts base casting form 22 having a portion of its sidewalls 26 removed and casting skin 27 left on. As described further below, casting skin 27 is used to form a casting surface 11 (discussed later with respect to FIG. 8) of the resulting concrete base 10. FIG. 3 depicts base casting form 22 with all side walls 26 attached. As shown, each sidewall 26 is removably attached to steel frame 25. FIG. 4 depicts base casting form 22 with a suspended framework 28 having a plurality of forming rods 29 attached thereto. Suspended framework 28 may be coupled to side walls 26 via coil bolts, and side walls 26 may also be coupled to base casting form 22 via coil bolts. Each forming rod 29 allows for the formation of a hole 13 (FIG. 6) at a specific and targeted location on concrete base 10. Suspended framework 28 may also include mold-in form attachments to provide a guide for each forming rod 29. As described below, each hole 13 may allow for correspondence with hardware added in subsequent steps. At this point, base 10 may be formed.

Figure 5:
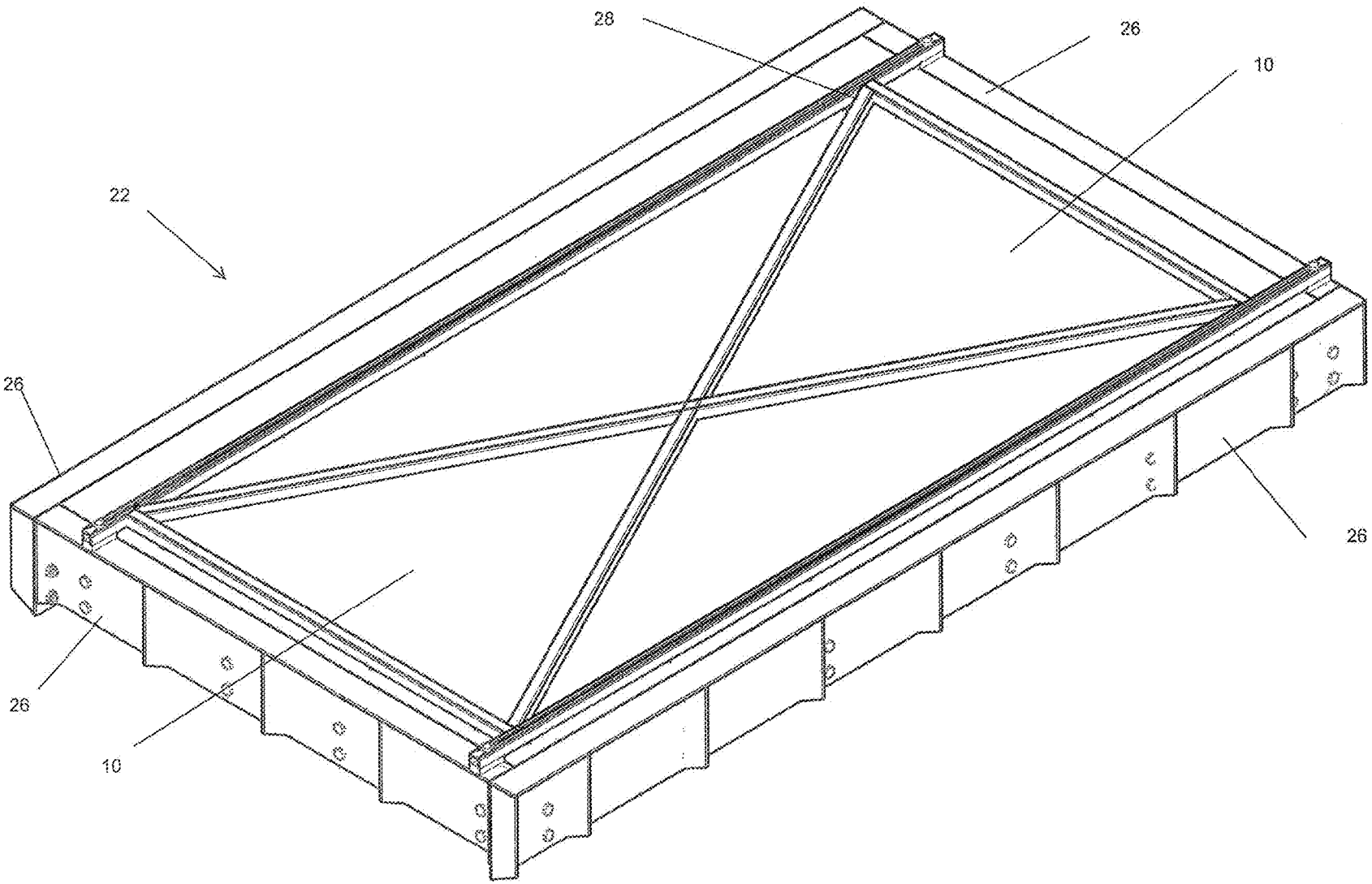
FIG. 5 illustrates a perspective view of a base casting form with a suspended framework with a concrete base having been poured, according to an aspect of this disclosure.
Figure 6:
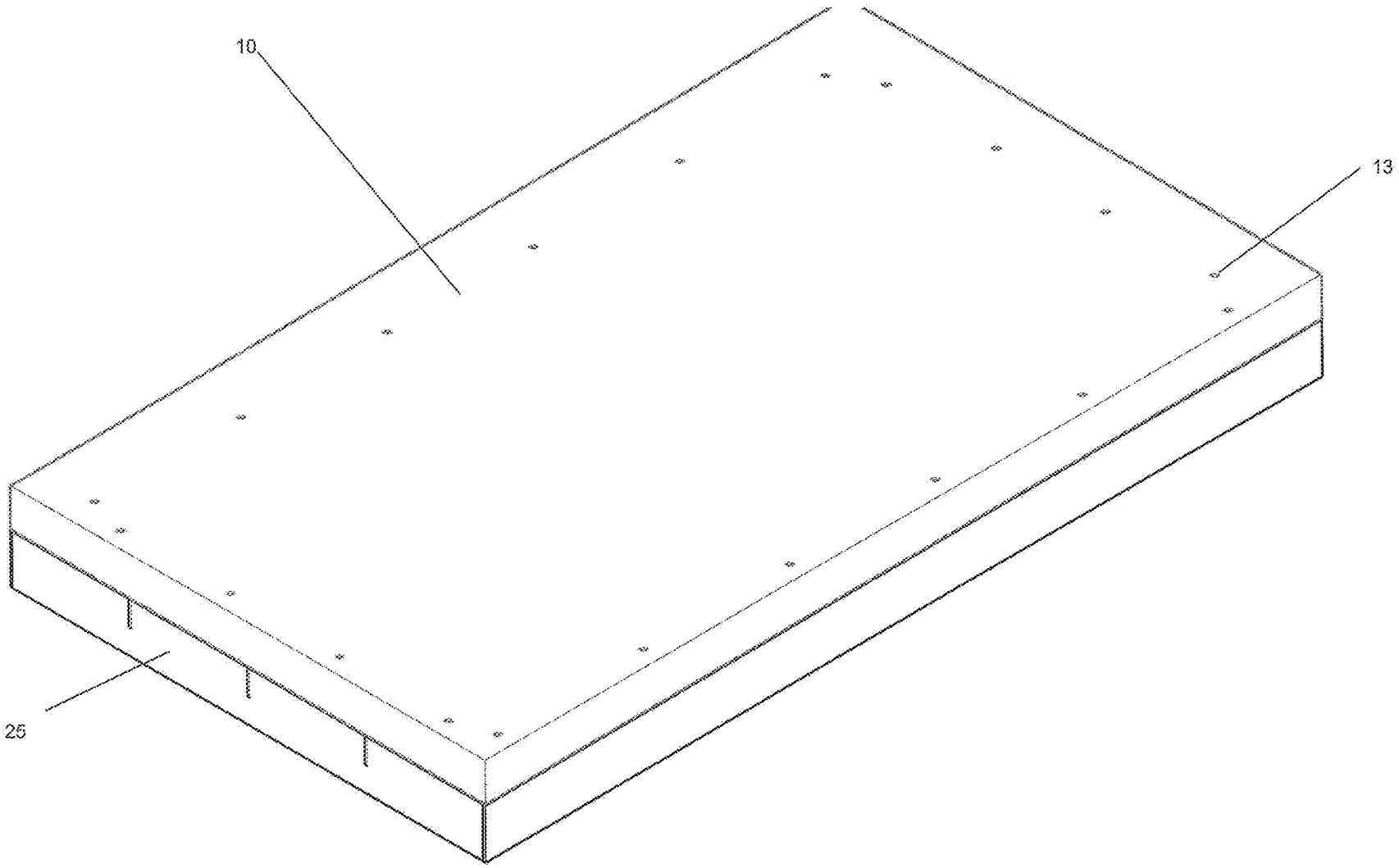
FIG. 6 illustrates a perspective view of a base casting form with a concrete base having been poured and set, according to an aspect of this disclosure.
Figure 7:
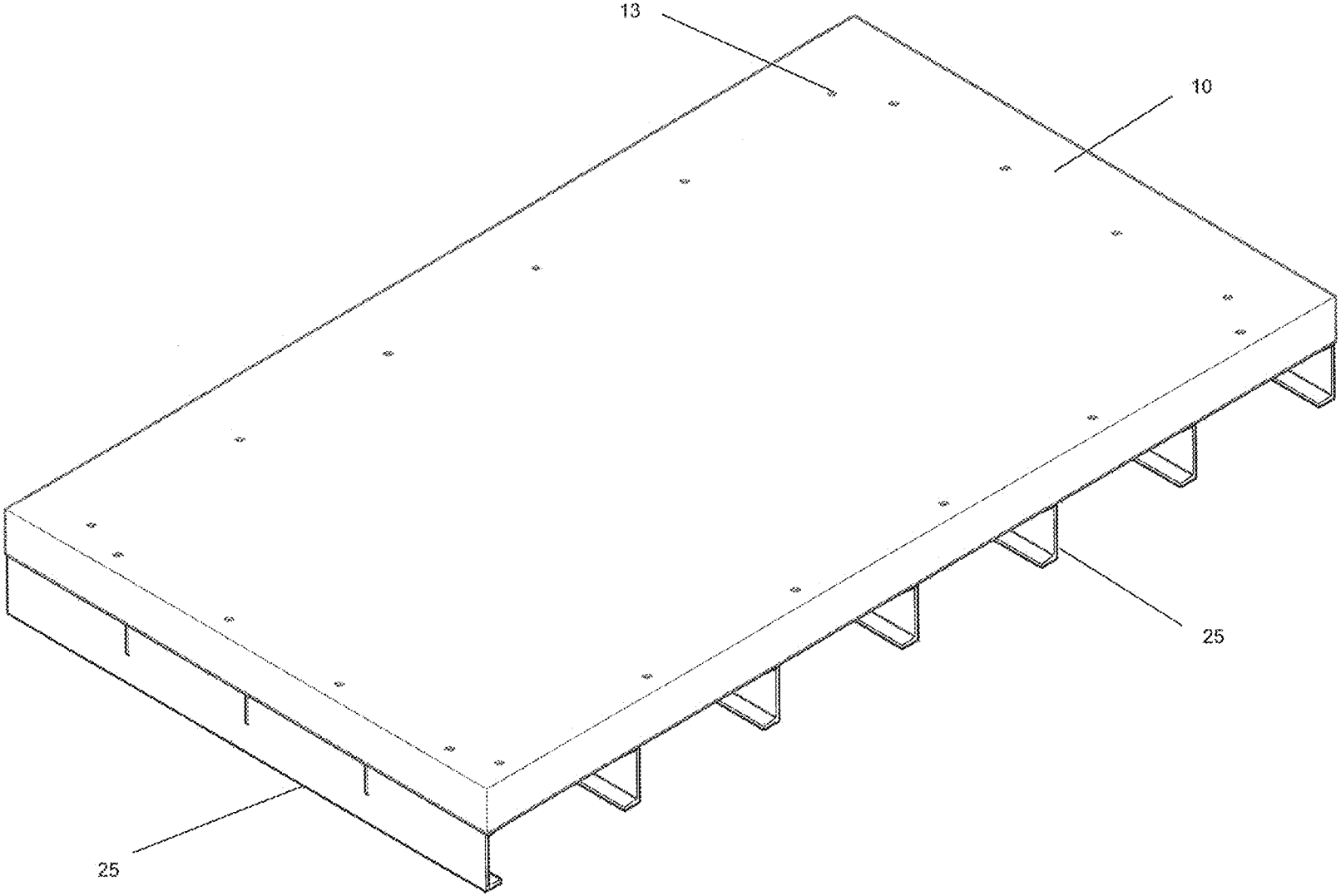
FIG. 7 illustrates a perspective view of a base casting form with a concrete base having been poured and set and with the side walls and framework removed, according to an aspect of this disclosure.
Figure 8:
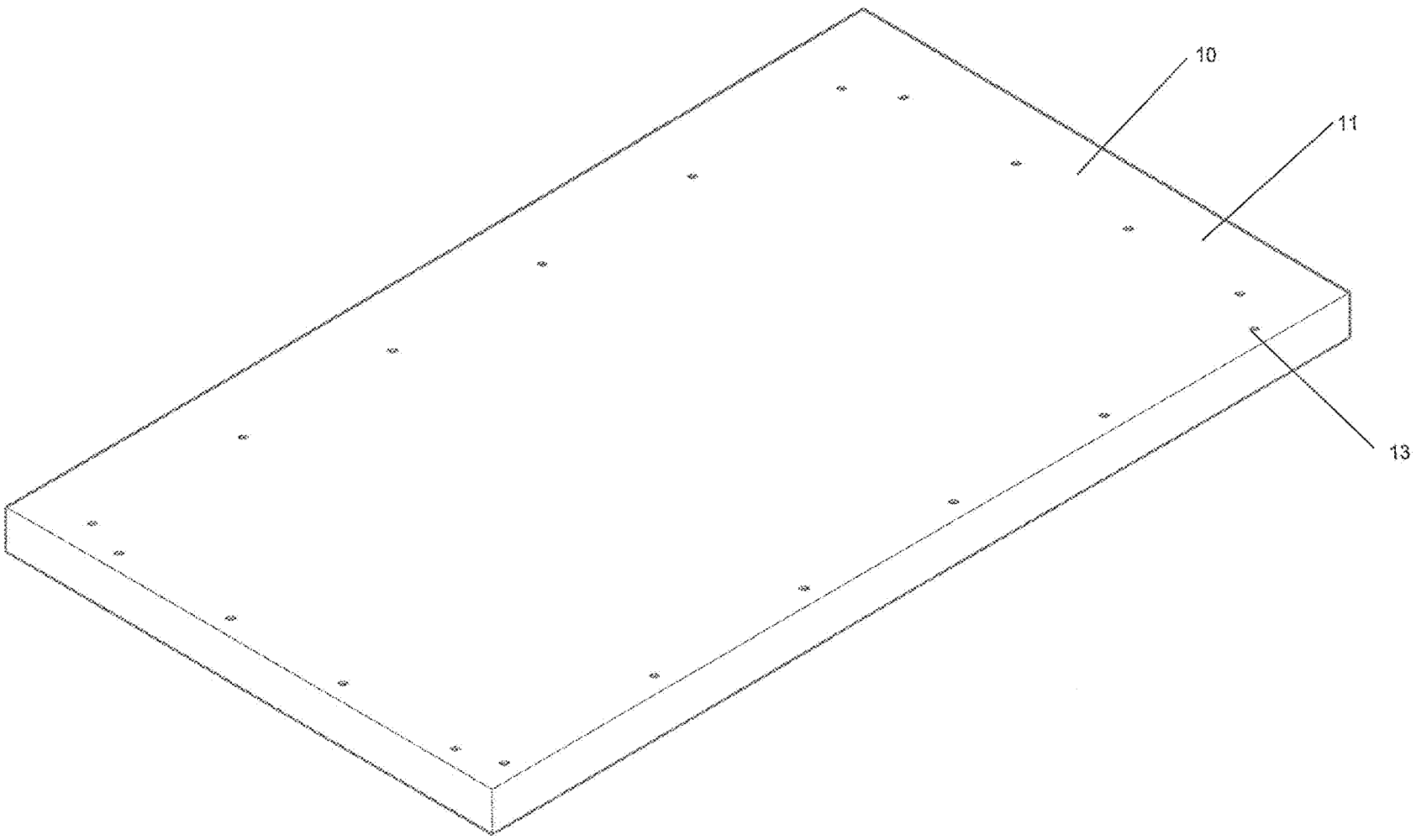
FIG. 8 illustrates a perspective view of a concrete casting base, according to an aspect of this disclosure.

FIG. 5 depicts base casting form 22 with a concrete base 10 having been poured, and with suspended framework 28 and sidewalls 26 not yet removed. FIG. 6 depicts base casting form 22 with concrete base 10 having been poured and set. Holes 13 have been formed into the concrete base 10 according to the location of the forming rods 29 attached to suspended framework 28 (FIG. 4). Sidewalls 26 have been removed. FIG. 7 depicts the base casting form 22 with the concrete base 10 being poured and cured, with the side walls 26 and side framework removed to reveal steel frame 25. FIG. 8 depicts concrete casting base 10 after being removed from base casting form 22 and flipped 180 degrees so that casting surface 11, previously facing towards casting skin 27 (i.e., down), is now facing away from casting skin 27 (i.e., up). As shown, each hole 13 may extend entirely through base 10. Alternatively, each hole 13 may be tapered through base 10 or may be sized to lockably receive a screw, which may include a socket head cap or a coil bolt hex nut, to secure concrete base 10 to a support. Forming concrete casting base 10 and its casting surface 11 out of concrete in this manner will greatly improve its durability and lifespan. At this point, concrete panel form 32 may be formed on base 10.

Figure 9:
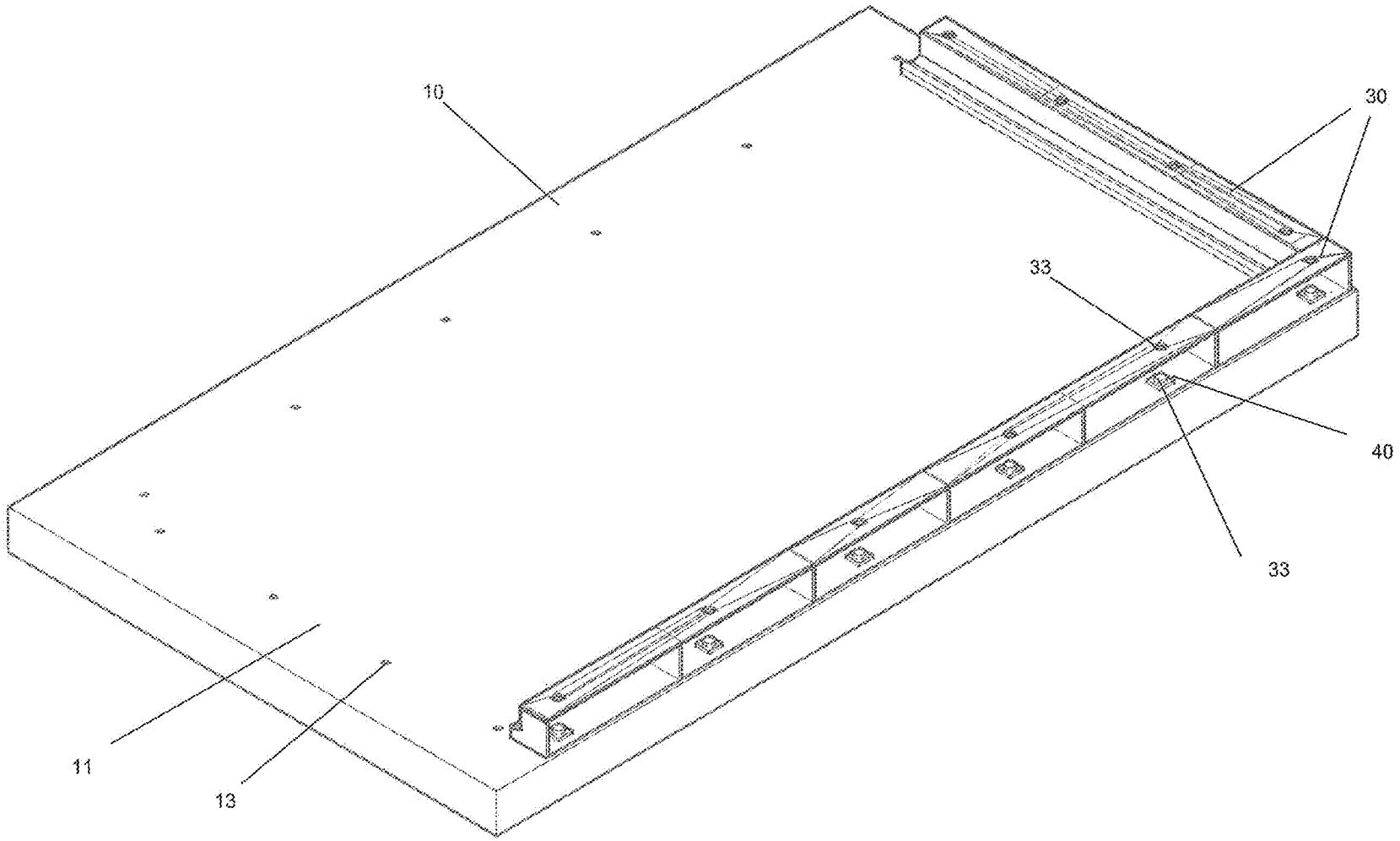
FIG. 9 illustrates a perspective view of a concrete casting base with a first portion of casting rails attached, according to an aspect of this disclosure.
Figure 10:
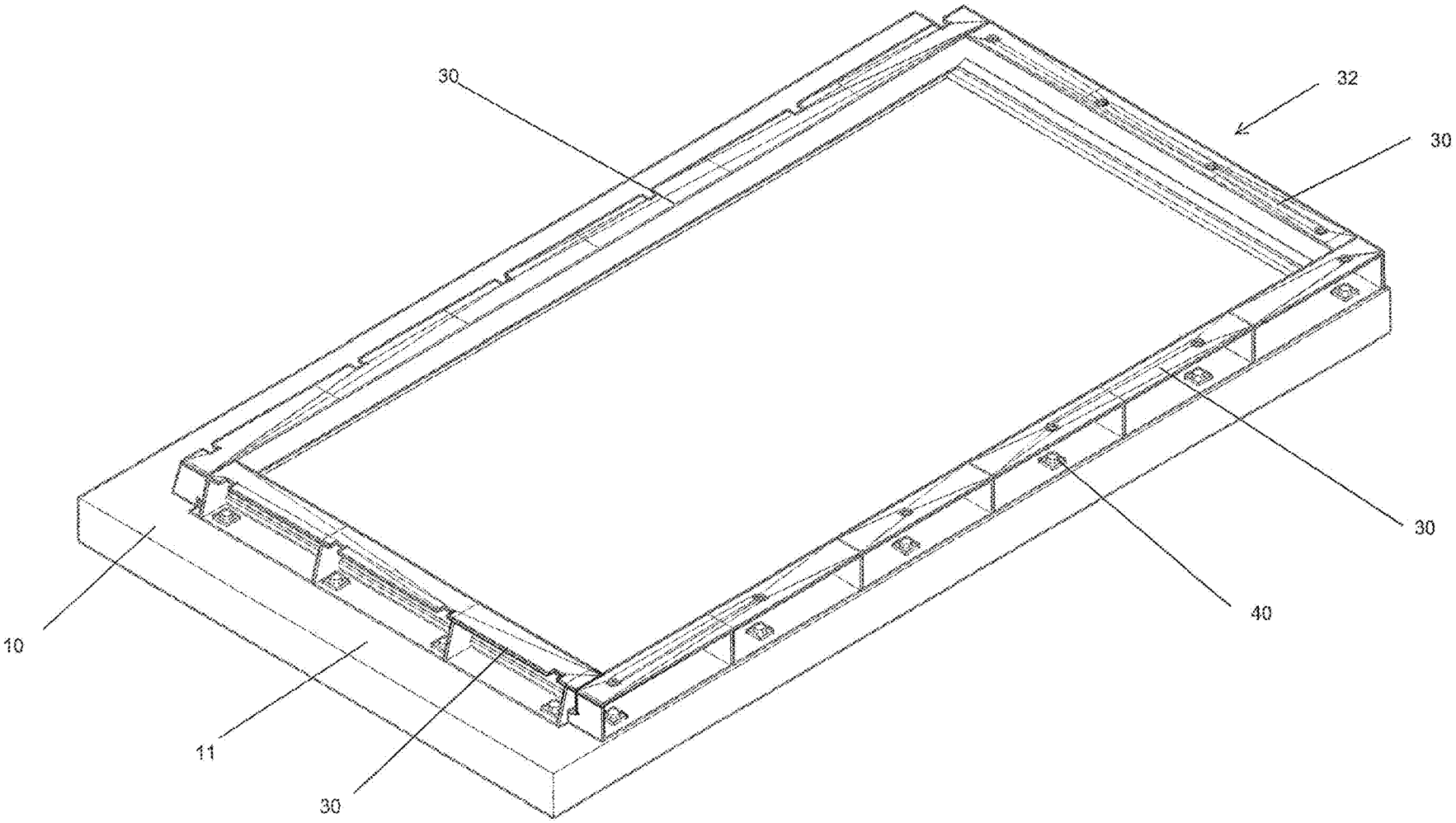
FIG. 10 illustrates a perspective view of a concrete casting base with a first and a second portion of casting rails attached to form a concrete panel form, according to an aspect of this disclosure.
Figure 11:
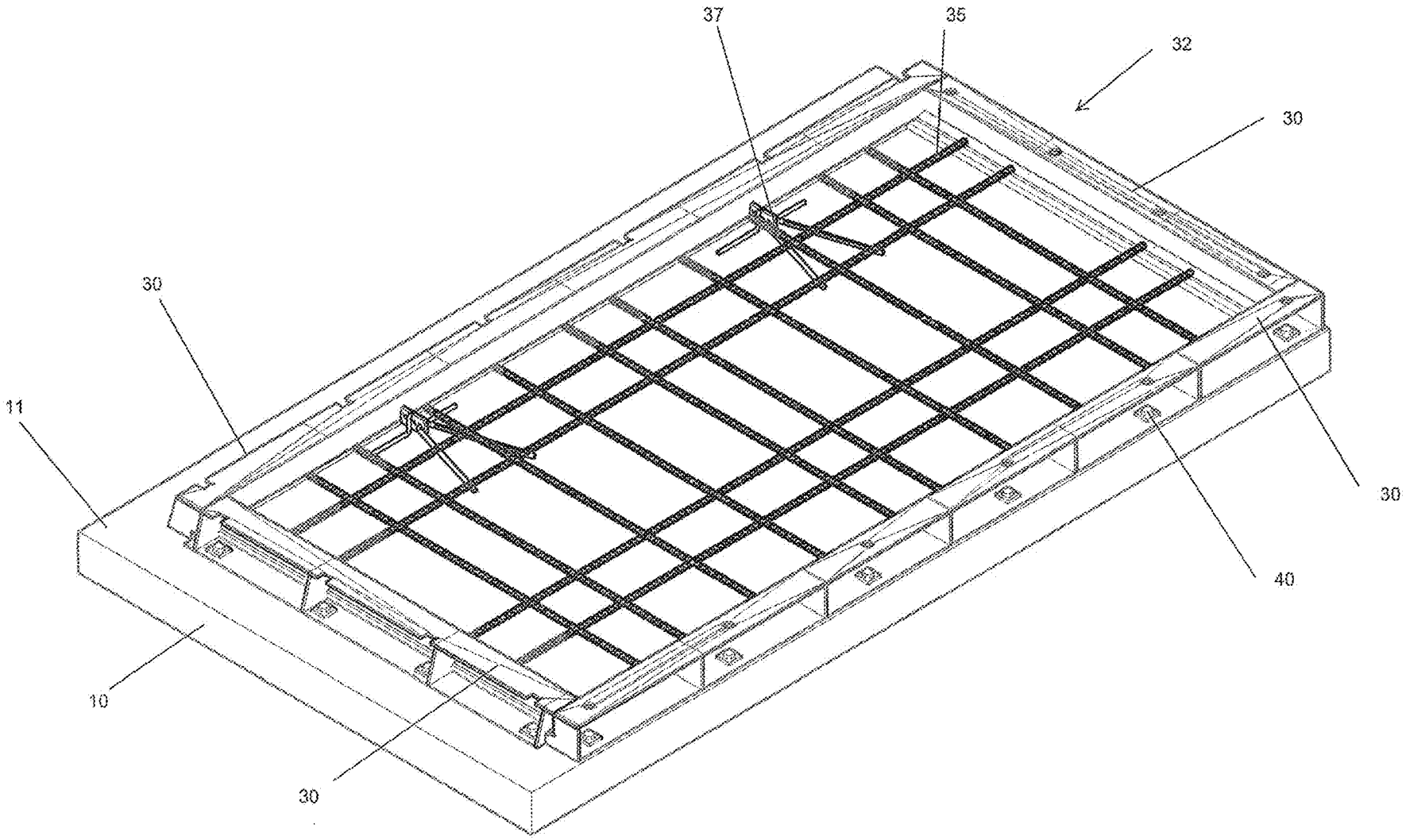
FIG. 11 illustrates a perspective view of a concrete casting base with a first and a second portion of casting rails and internal hardware attached, according to an aspect of this disclosure.
Figure 12:
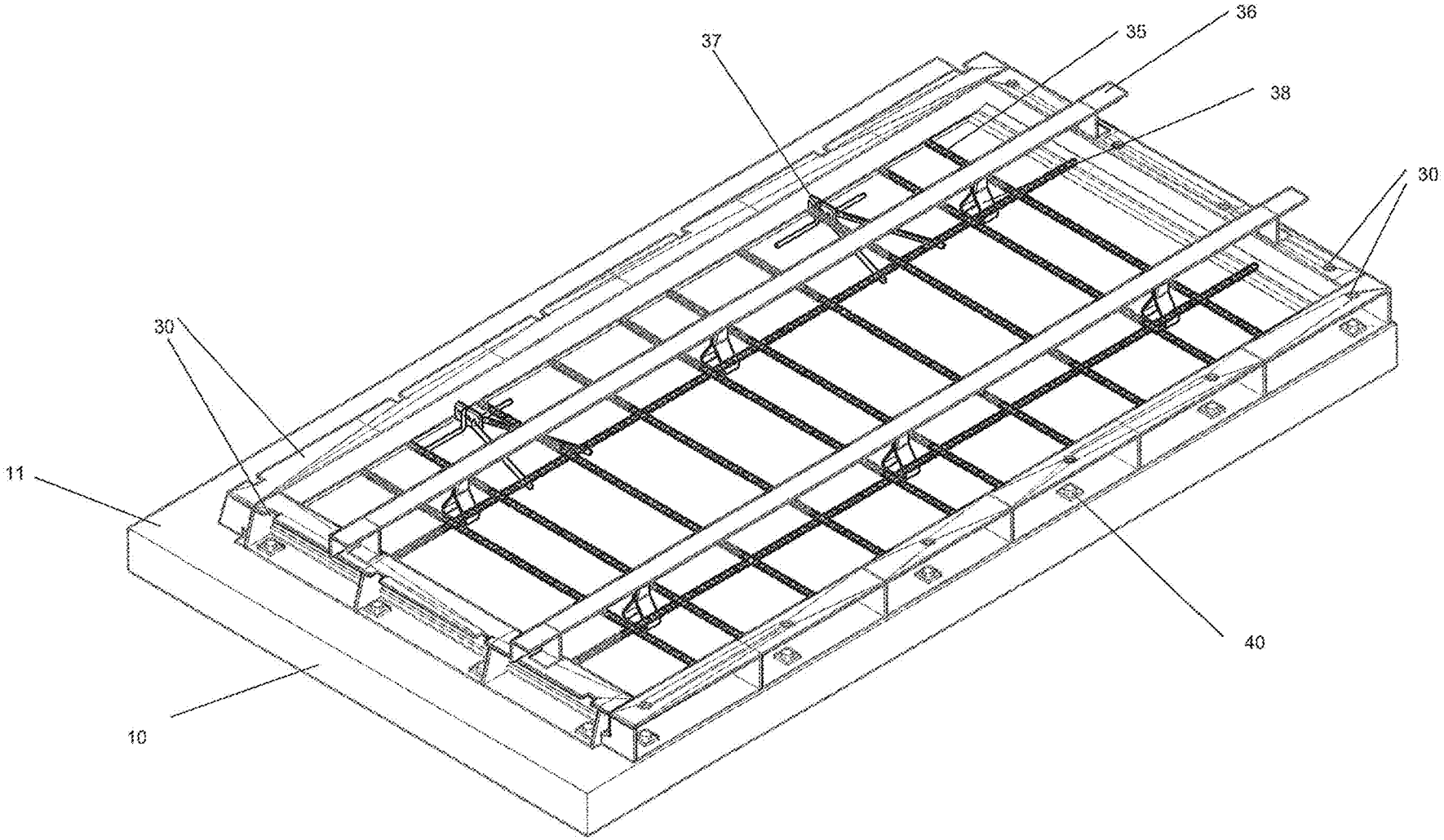
FIG. 12 illustrates a perspective view of a concrete casting base with a first and a second portion of casting rails, internal hardware, and an overhead hanging rail system attached, according to an aspect of this disclosure.

FIG. 9 depicts a first portion (e.g., the first two) of the casting rails 30 attached to casting surface 11 of concrete base 10. Each rail 30 is attached, for example, by inserting an anchor 40 through one or more holes 33 in each rail 30, and into one of the holes 13 formed into concrete base 10 using suspended framework 28 (FIG. 4). FIG. 10 depicts a second portion (e.g., the second two) of the casting rails 30 attached to casting surface 11 of concrete base 10 by inserting one or more anchors 40 through the one or more holes 33 of rail 30. At this point, concrete panel form 32 is formed as a closed perimeter on concrete casting base 10. FIG. 11 depicts the addition of internal hardware to concrete panel form 32, such as reinforcement 35 (e.g., rebar) and various attachment devices 37 usable to, for example, attach the finished panel 12 to a structure. FIG. 12 depicts the addition of an overhead hanging rail system 36 used to locate suspended engineered embed locations 38. As shown, overhead hanging rail system 36 may be removably attached to each rail 30 of concrete panel form 32 and each embed location 38. At this point, panel 12 may be formed by pouring concrete into form 32.

Figure 13:
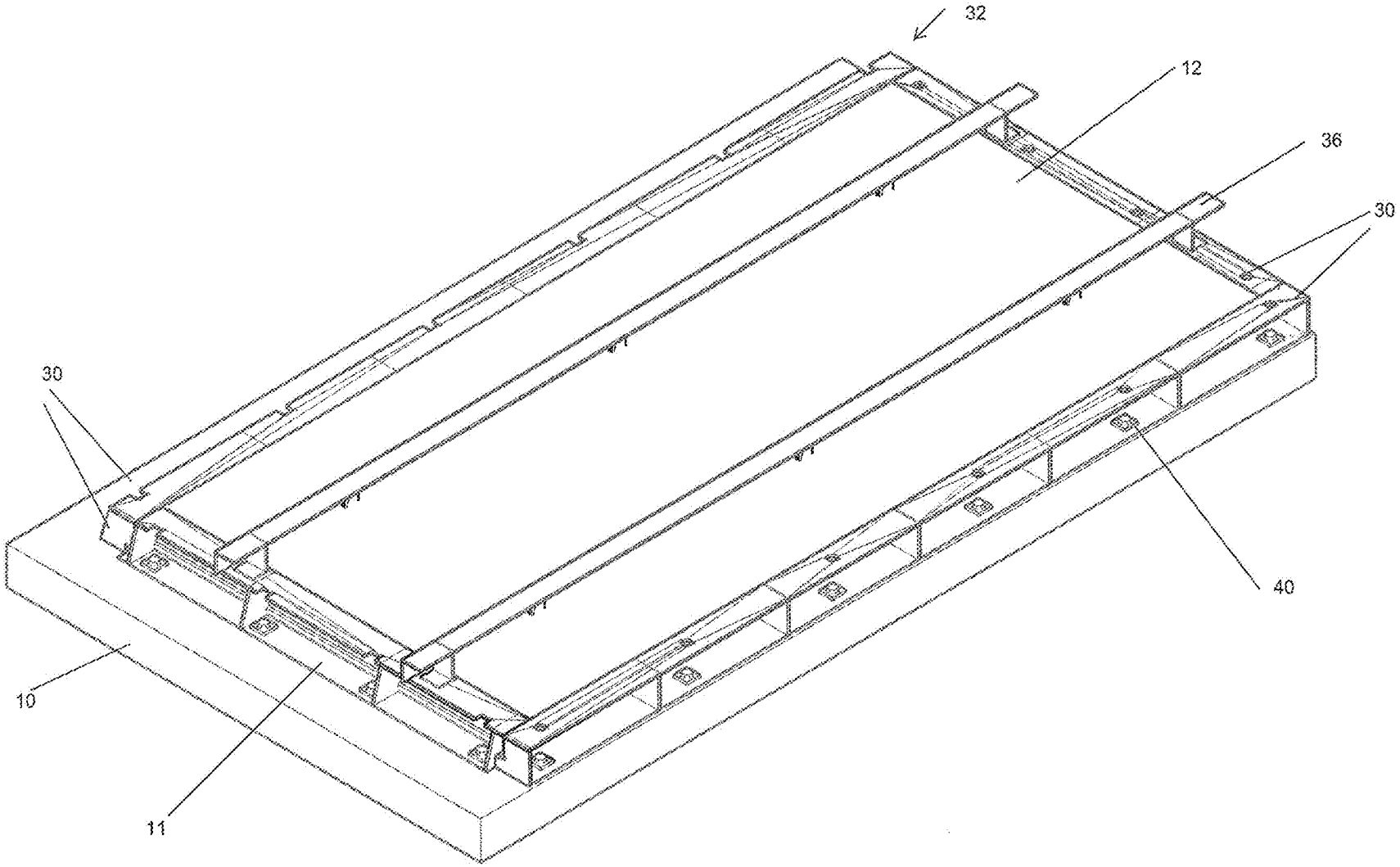
FIG. 13 illustrates a perspective view of a concrete casting base with a first and a second portion of casting rails, internal hardware, and an overhead hanging rail system attached, and with a panel having been poured in a concrete panel form, according to an aspect of this disclosure.
Figure 14:
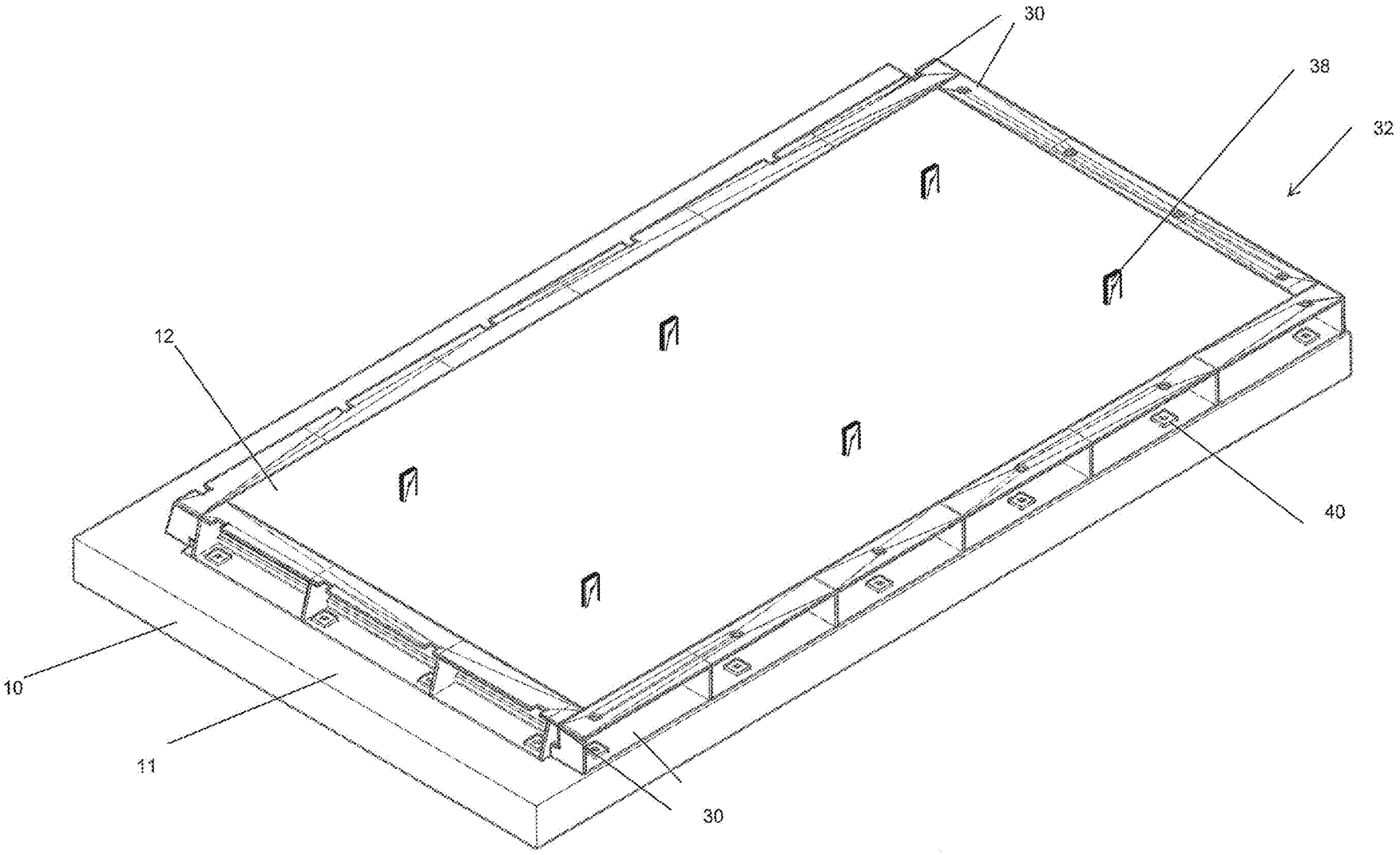
FIG. 14 illustrates a perspective view of a concrete casting base with a first and a second portion of casting rails, a panel having been poured, and the overhead hanging rail system removed, according to an aspect of this disclosure.

FIG. 13 is a post-pour depiction of panel 12 in concrete panel form 32. The hardware, such as overhead hanging rail system 36, has not yet been removed. FIG. 14 is a post-pour depiction of panel 12 after the hardware, such as overhead hanging rail system 36, has been removed from concrete panel form 32, and detached from each engineering embed location 38. As shown, each location 38 now extends out from panel 12 at a predetermined location. At this point, panel 12 may be removed from concrete panel form 32, for example, by application of a lifting force to one or more of the suspended engineered embed locations 38.

Figure 15:
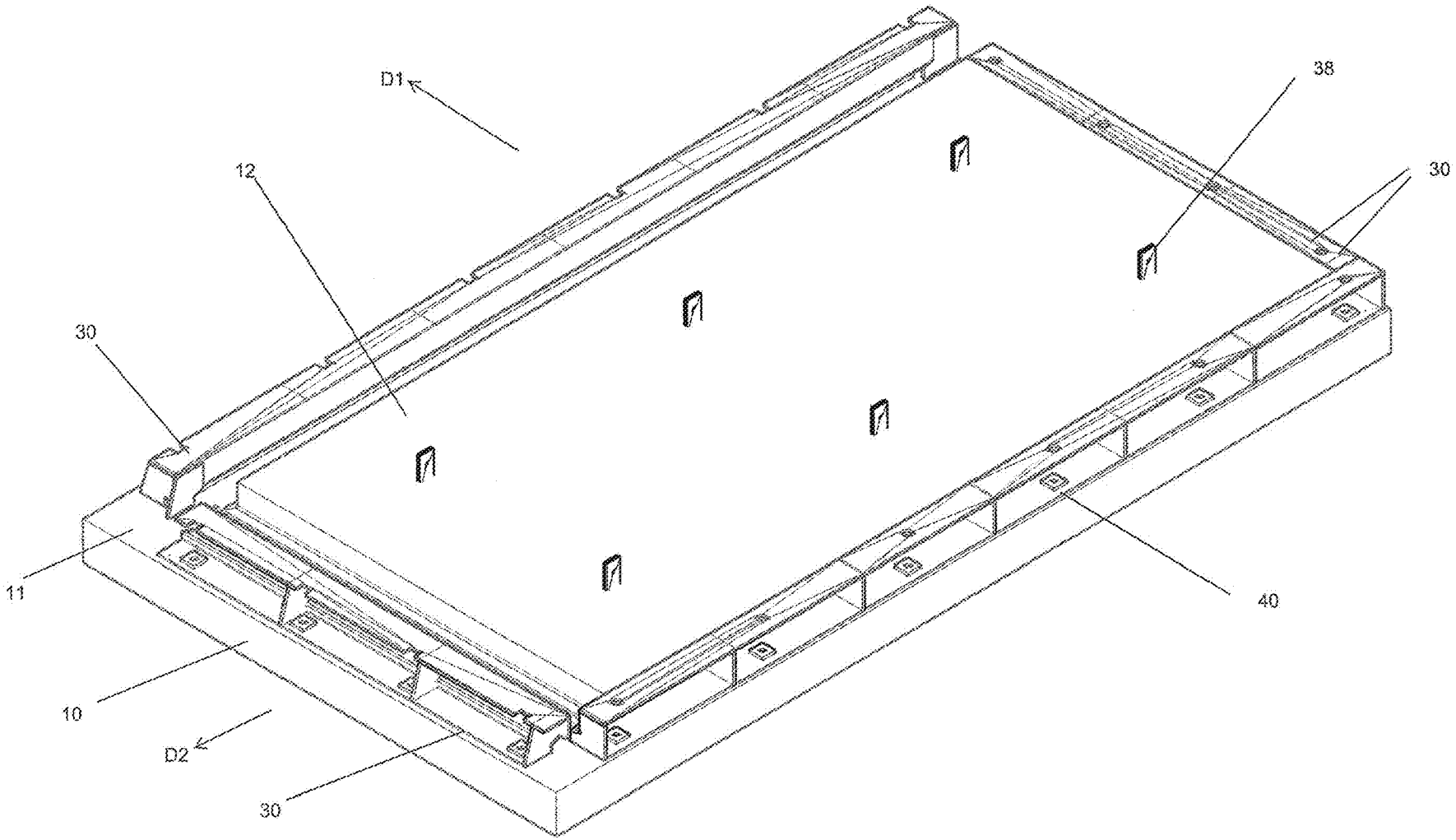
FIG. 15 illustrates a perspective view of a concrete casting base with a first portion of casting rails attached and a second portion of casting rails being removed, and a panel having been poured and set, according to an aspect of this disclosure.
Figure 16:
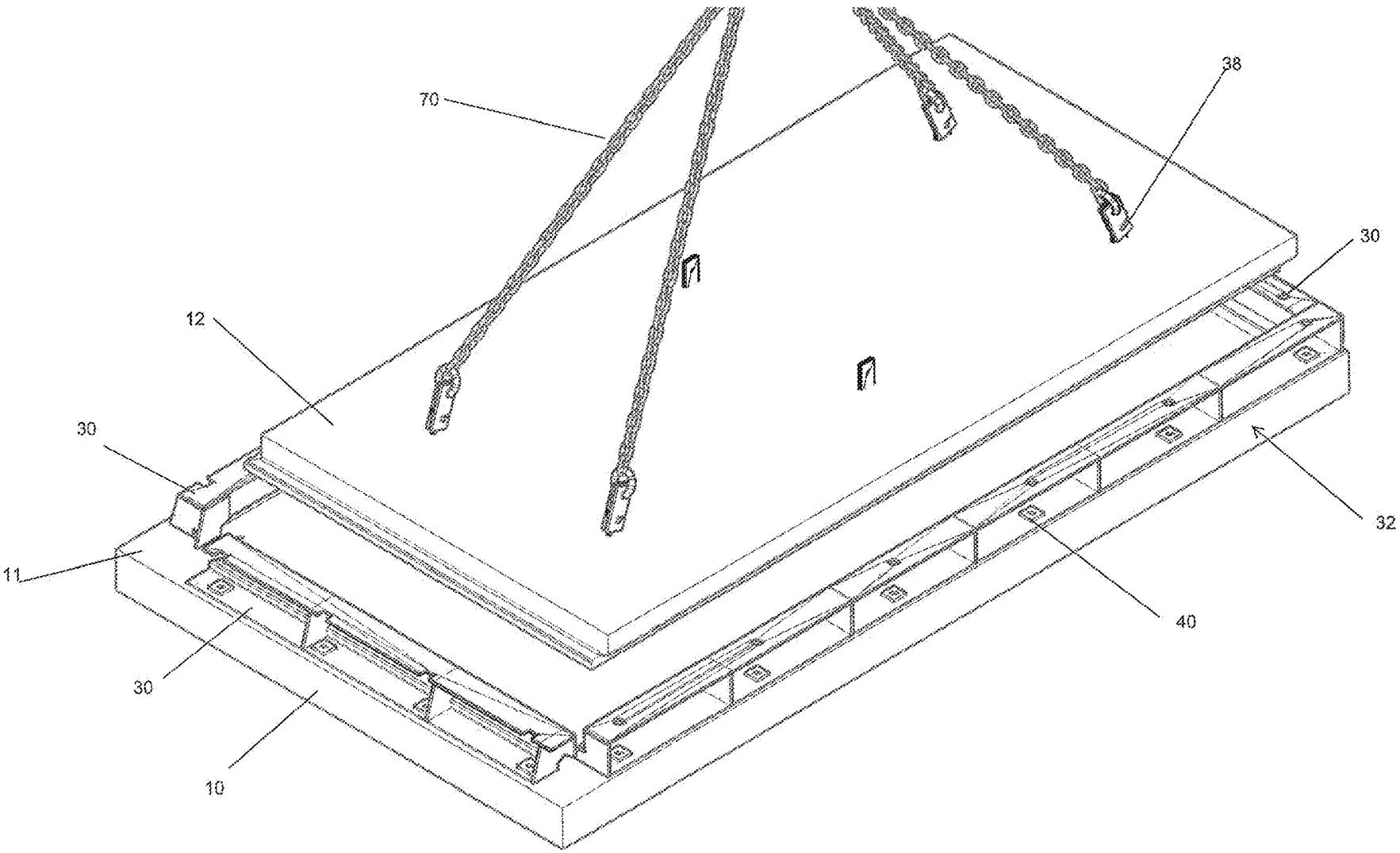
FIG. 16 illustrates a perspective view of a poured and set panel being removed from a concrete casting base with the aid of a chain, according to an aspect of this disclosure.
Figure 17:
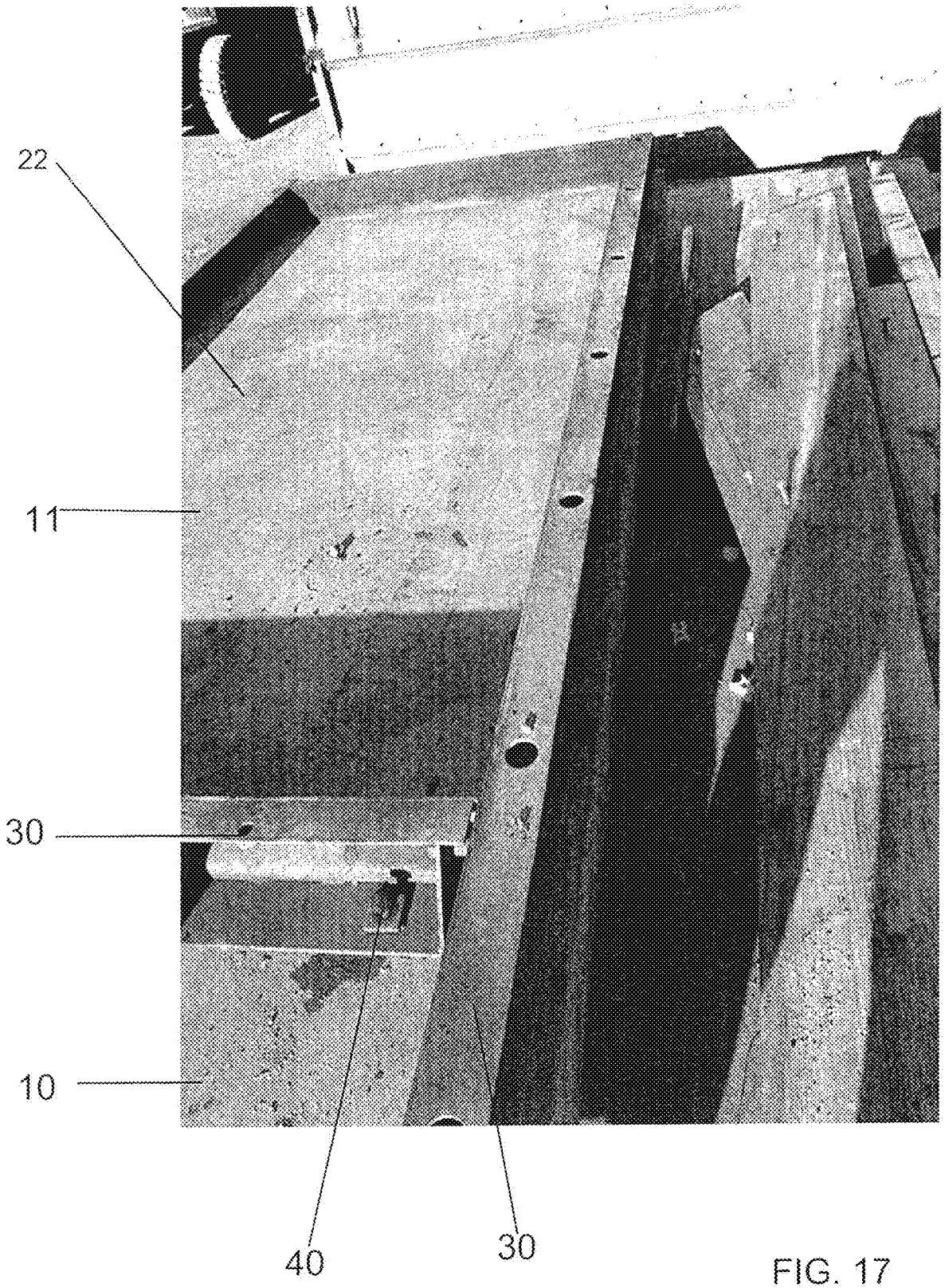
FIG. 17 illustrates a perspective view of an exemplary concrete base with casting rails attached to form a base casting form, according to an aspect of this disclosure.
Figure 18:
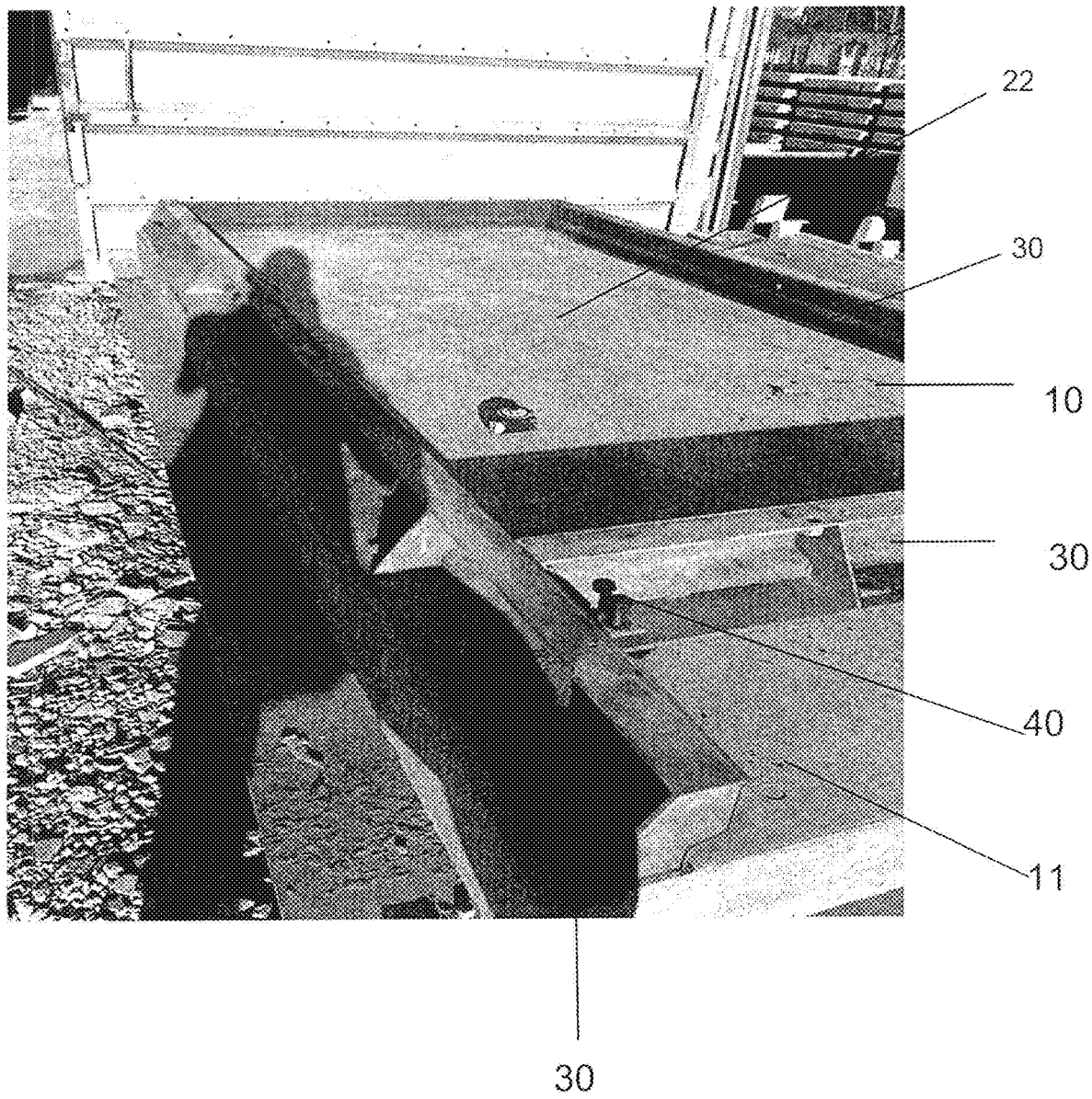
FIG. 18 illustrates an additional perspective view of an exemplary concrete base with casting rails attached to form a base casting form, according to an aspect of this disclosure.
Figure 19:
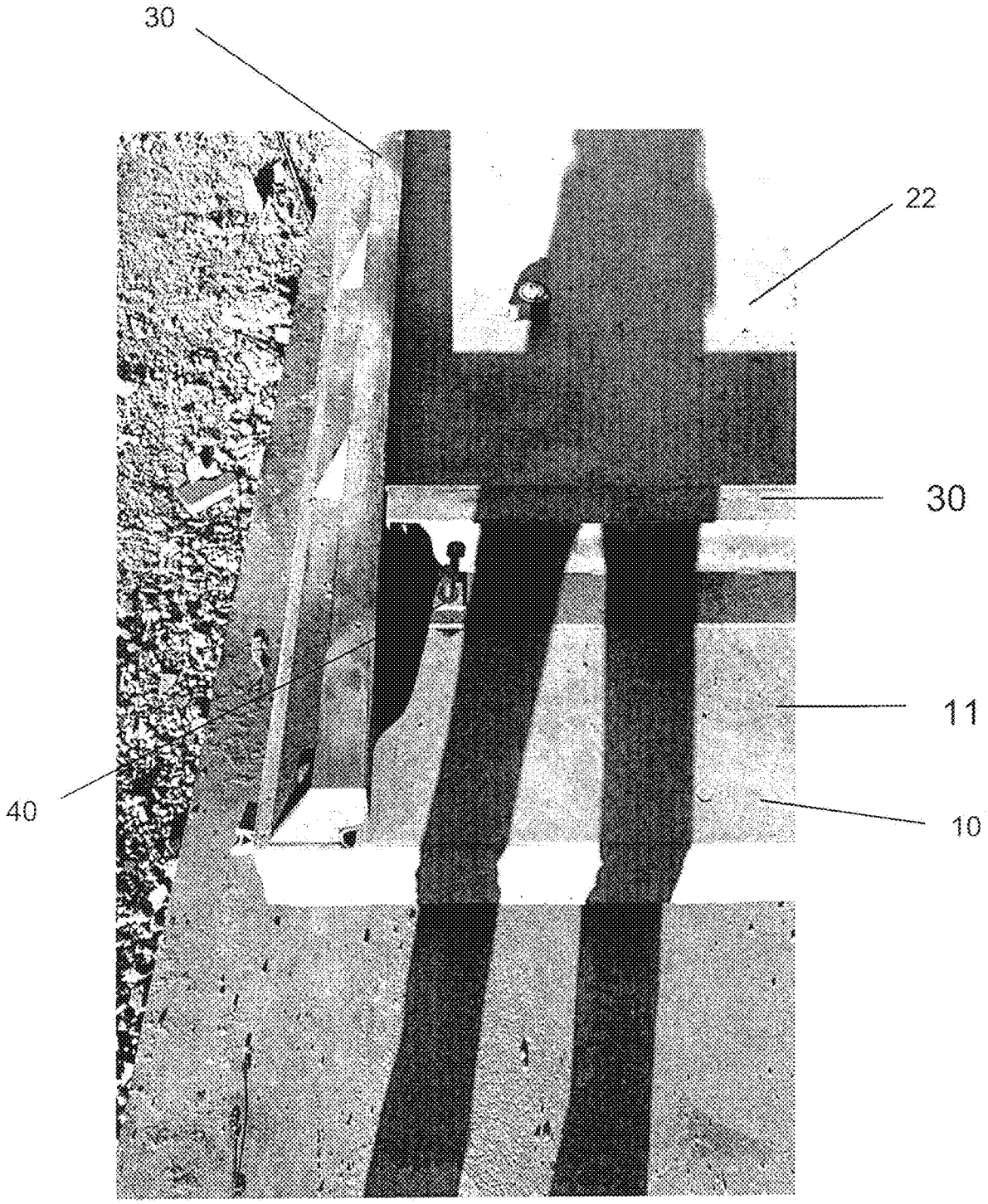
FIG. 19 illustrates a portion of an exemplary concrete base with casting rails attached to form a base casting form, according to an aspect of this disclosure.
Figure 20:
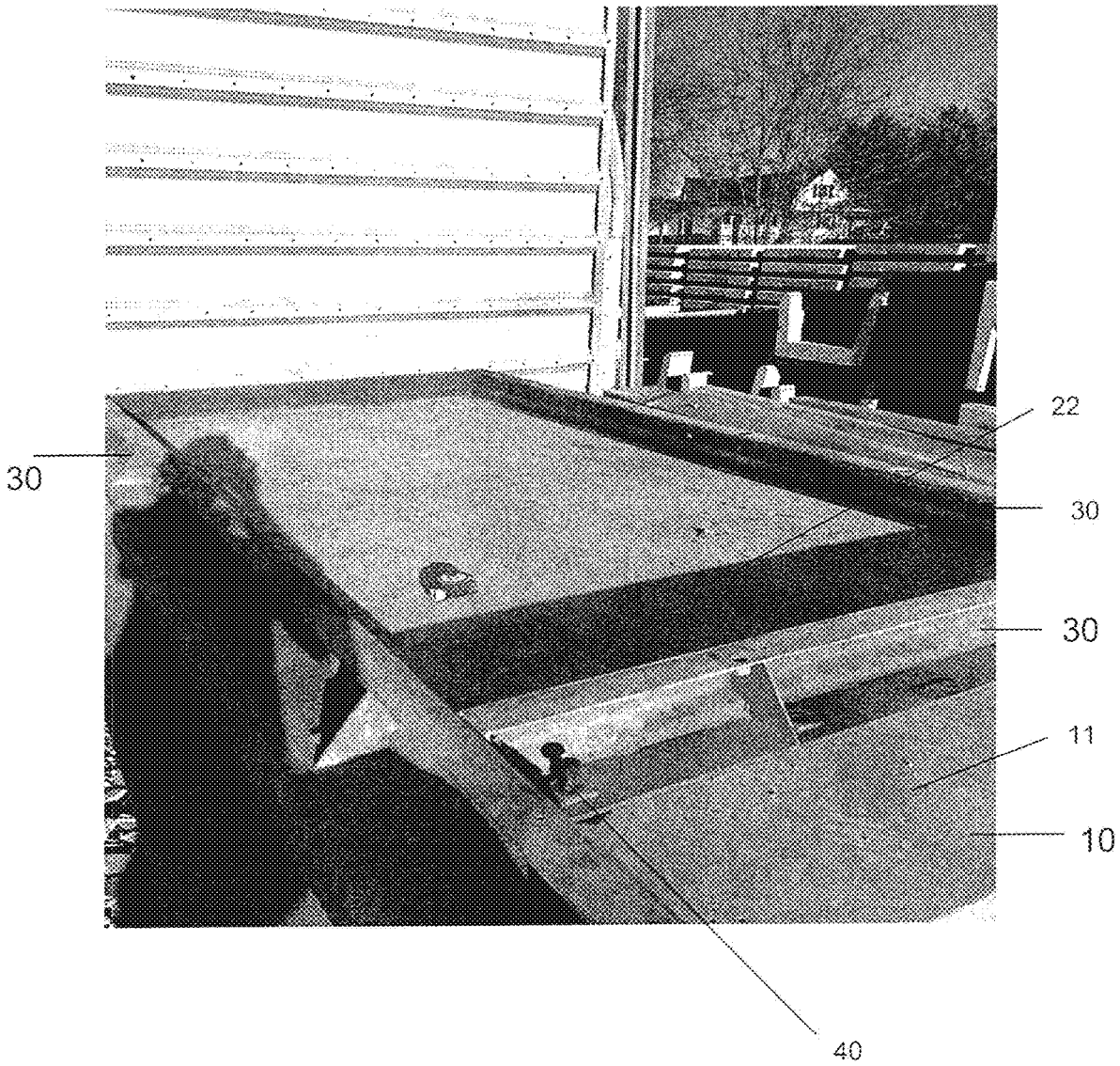
FIG. 20 illustrates a further perspective view of an exemplary concrete base with casting rails attached to form a base casting form, according to an aspect of this disclosure.

FIG. 15 shows a portion of casting rails 30 (e.g., the top and left rails 30) being moved away from panel 12 on concrete casting base 10 to permit removal of panel 12, each respective movement being indicated by an arrow D1 or D2. These rails 30 may be moved, for example, by removing each anchor 40 from base 10, and then moving (e.g., lifting and/or sliding) each rail 30 away from panel 12. FIG. 16 shows panel 12 being removed from concrete panel form 32 after each rail 30 has been removed from concrete casting base 10 in the described manner. To facilitate removal, a chain 70 is attached to a crane or other lifting means configured to apply a lifting force to at least a portion of suspended engineered embed locations 38. Panel 12 is then removed by the crane.

An exemplary concrete casting base 10 with an attached panel casting form 22, comprising of rails 30 attached by anchors 40, is also depicted in FIGS. 17-20 for additional detail. For example, the concrete panels 12 may be formed in an assembly line, automated, or semi-automated process.

A base casting form 22 may be constructed and used to form a concrete casting base 10 as discussed above. Then, the concrete casting base 10 may be used to define a concrete panel form 32 to form a plurality of concrete panels 12. Similar lifting or positioning equipment may be used to manipulate the concrete casting form 22, side walls 26, concrete casting base 10, casting rails 30, concrete panel 12, and the other elements included in the discussed kit, method, and system.

It is also noted that multiple concrete casting bases 10 may be formed from one base casting form 22 by repeating the above concrete casting base formation process. Then, multiple concrete panels 12 may be formed on each of the formed concrete casting bases 10 by repeating the above concrete panel formation process. The concrete casting bases 10 may also be transported such that the plurality of concrete panels 12 may be produced away from the base casting form 22. It is also noted that the suspended framework 28, forming rods 29, the casting rails 30, anchors 40, and/or other components may require replacement over time or between iterations of forming concrete bases 10 and/or concrete panels 12, for example, due to damage or corrosion. These replaceable components may be standardized and may be replaced individually, in groups of components, or in a wholesale replacement. Nevertheless, the aforementioned concrete elements and production processes increase the repeatability and speed at which both concrete bases 10 and concrete panels 12 may be produced.

Additional variations of concrete casting base 10, panel 12, base casting form 22, the plurality of rails 30, and concrete panel form 12 are now described with reference to FIGS. 1-16. Any aspect of these variations may be incorporated into any of the kits, methods, and/or systems described herein, each possible combination being part of this disclosure.

Either of concrete casting base 10 (FIG. 8) or panel 12 (FIG. 16) may be any size, although base 10 is generally larger than panel 12. For example, concrete casting base 10 may be about 5 to 12 inches thick, and of appropriate width and length to produce numerous panels 12 of varying size. In accordance with this example, a panel 12 may be about 5½ inches thick, about 5 foot tall and either about 5, 9 or 10 foot wide. Rails 30 may be moved relative to one another on base 10 to modify the dimensions of panel casting form 22. Either of concrete casting base 10 or panel 12 may have reinforcing added, for example, in locations expected to be in tension or subjected to shear stress. An exemplary layout of reinforcement 35 in panel 12 is shown in FIG. 11, although any layout may be used. Exemplary forms of reinforcement 35 may include bars, fibers, or wires made of a metallic material (e.g., steel), a synthetic material (e.g., fiberglass), or any material configured to improve concrete strength.

Figure 21A:
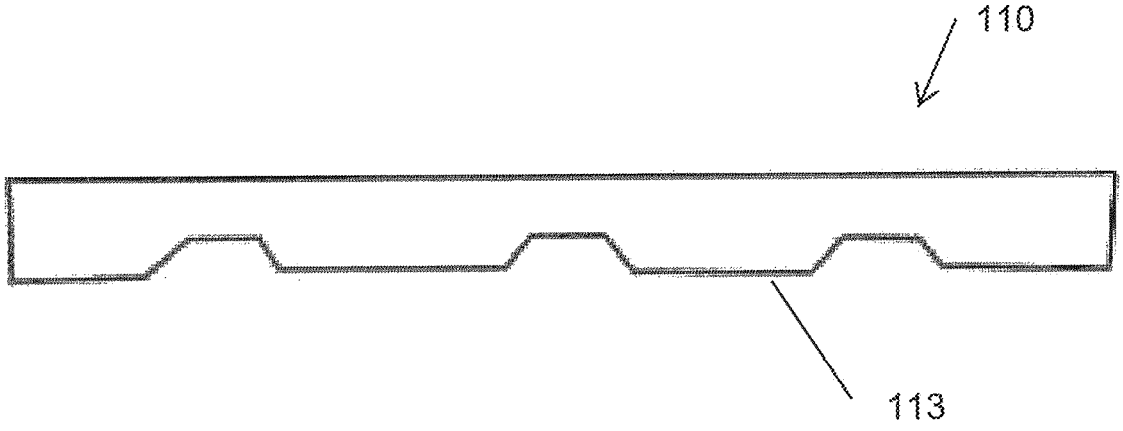
FIGS. 21A-21C illustrate additional embodiments of the concrete casting base, according to aspects of this disclosure.
Figure 21B:
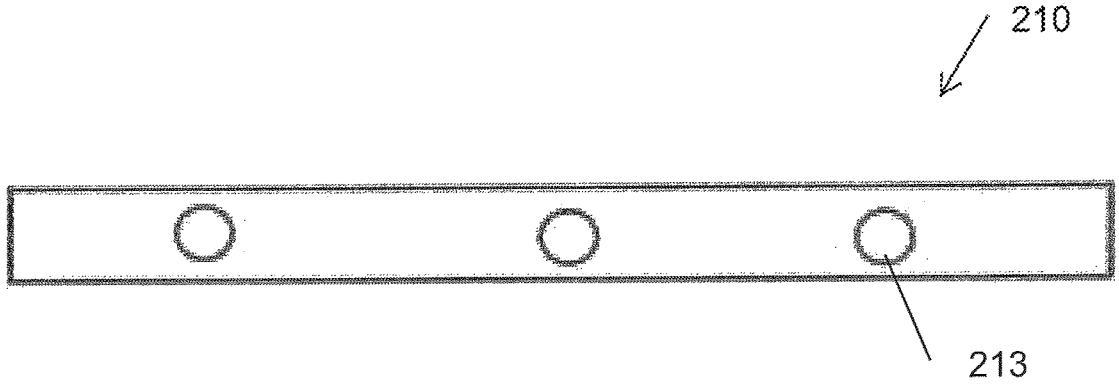
Figure 21C:
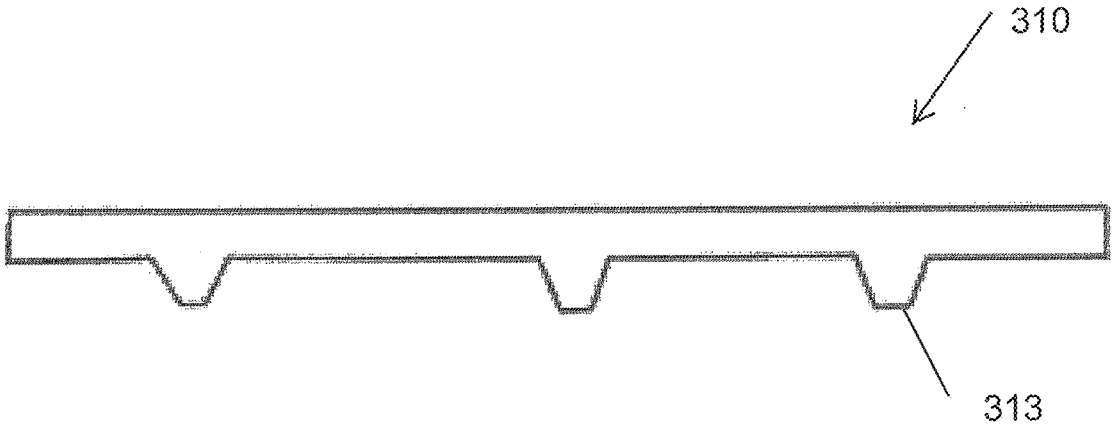

Either of concrete casting base 10 or panel 12 may be modified for weight reduction. For example, the concrete used to make concrete casting base 10 or panel 12 could be conventional concrete. Alternatively, the concrete may be modified to reduce the weight of concrete casting base 10 or panel 12 with the use of lightweight aggregates, lightweight concrete, or foam concrete. Panel 12 may be produced with a first concrete, while panel 12 is produced with a second concrete. Alternatively still, either or both of concrete casting base 10 or panel 12 may be produced of alternative materials, like glass, plastic, or rubber, which may be similarly formed and/or reinforced as described herein. The cross-sectional shape of base 10 or panel 12 may also be modified for even further weight reduction. For example, an exemplary set of bases 110, 210, and 310 are illustrated in FIGS. 21A-C, each being modified to both reduce weight and/or improve load carrying capacity. Base 110 (FIG. 21A), for example, has been poured with a corrugated bottom surface 113. Base 210 (FIG. 21B) has a number of exemplary hollow sections 213, shown as cylindrical. And base 310 (FIG. 21C) has a number of ribs 313. In each illustration, the amount of concrete required to make panels 110, 210, or 310 is reduced by features 113, 213, or 313. Reinforcement may be distributed in the remaining sections, as needed.

Plurality of rails 30 may be removably mounted to casting surface 11 of concrete casting base 10 to define panel casting form 32. For example, as noted above, each rail 30 may have one or more holes 33 sized to receive one of the anchors 40, which may then be inserted into one of the holes 13 formed in concrete casting base 10 to fix the position of rail 30 on base 10. Each hole 33 may be a slot, channel, or any like open or closed shape. Anchor 40 may be engageable with hole 13 of base 10. For example, a shaft portion of anchor 40 may have a set of threads that are engageable with a corresponding set of threads in hole 13. Alternatively, each hole 13 may be a durable collar (e.g., steel) that is formed into concrete casting base 10. This durable collar may provide a set of durable internal threads that are engageable with anchor 40. The collar may be removably attached to the suspended framework 28 described above. A quick-release attachment between anchor 40 and hole 13 is also contemplated. For example, to reduce setup time, anchor 40 may have a shaft with a retractable protrusion that is engageable with a catch formed in hole 13, or simply the underside of base 10. A quick-release button on anchor 40 may be used to operate the retractable protrusion. Accordingly, anchor 40 may be engaged with hole 13 when the protrusion is engaged with the catch, and then disengaged by operating the quick release button to move the protrusion out of the catch. Additionally, holes 13 in concrete casting base 10 may be formed after formation of the concrete casting base 10. For example, holes 13 may be drilled or otherwise formed in the solidified or partially solidified concrete casting base 10, rather than being formed by the forming rods 29.

Each rail 30 may also be movably mounted to concrete casting base 10. For example, each hole 33 of rail 30 may be an elongated slot that allows each rail 30 to be moved relative to concrete casting base 10, with or without removing anchor 40, in a direction parallel to casting surface 11. For example, anchor 40 may be tightened against rail 30 to fix the position of concrete panel form 32 pre-pour, and then loosened to permit the sliding movement of each rail 30 relative to base 10 and anchor 40 post-pour, once panel 12 has been formed. The undersurface of each rail 30 may be slid directly on casting surface 11. Alternatively, to reduce friction and increase durability, concrete casting base 10 may be formed to have a cross-section (e.g., a track) that corresponds with a cross-section of the underside of rail 30 (e.g., a protrusion sized for receipt in the track), such that each rail 30 may be slid away from panel 12 by guiding the protrusion along the track. Friction may be further reduced by application of a friction-reducing coating (e.g., Teflon or like composition) to casting surface 11 and/or the underside of each rail 30. These configurations allow each rail 30 to be moved relative to concrete casting base 10 without having to lift rail 30 or completely remove anchor 40, thereby reducing setup and reset times and increasing safety.

Furthermore, rails 30 may impart a desired shape to the panel 12. For instance, as shown in FIGS. 9-16, rails 30 may have an inwardly facing surface that is partially ridged, either inwardly or outwardly. In one example shown in FIG. 16, the rails 30 on a right side and a back side of the concrete casting form 32 may include an extension toward the opening for the concrete to be poured, and the rails 30 on a left side and a front side of the concrete casting form 32 may include an indentation away from the opening for the concrete to be poured. The extensions and indentations in rails 30 on either side of casting surface 11 may correspond to each other. As such, the resulting panel 12 includes an indentation on the right side and the back side, and an extension on the left side and the front side (FIG. 16). The indentations and extensions in resulting panel 12 may provide for more efficient connection of the resulting panel 12 to other panels.

Casting surface 11 of concrete casting base 10 may be formed to produce a panel 12 having a specified architectural surface, such as brick, rock, or the like. This may be done, for example, by modification of casting skin 27, or by placing an elastomeric or polymer liner on casting surface 27. In some aspects, casting surface 11 may be modified for enhanced durability to ensure that the specified architectural surface may repeatedly produced. For example, casting surface 11 may be formed of a material that is different from the remainder of concrete casting base 10. This different material may, for example, make casting surface 11 more dense, less porous, more water impermeable, or the like. Concrete casting base 10 may be further reinforced with, for example, a reinforcing mesh that is placed at or just below casting surface 11 to both define the specified architectural surface and reinforce its contours. These configurations would, for example, eliminate the need for an elastomeric or polymer liner, thereby increasing production speed.

Concrete casting base 10 may include elements that further increase production speed by decreasing the curing speed of panel 12. For example, concrete casting base 10 may have a plurality of temperature regulating elements extending therethrough, such as a hollow tube for receiving water at a specified temperature, a conductive heating element, or a reactive chemical layer applied to casting surface 11. In some aspects, the reinforcement means described above may also be used to regulate temperature. For example, concrete casting base 10 may be formed with a steel reinforcing mesh (e.g., similar to reinforcement 35) having a hollow interior that both increases the tensile strength of the concrete and decreases its curing time by permitting a steam of hot or cold water to flow therethrough.

Various hardware elements may be included in or used with the kits, methods, and/or systems described herein. For example, additional components or block-outs may be carefully coordinated and precisely located in concrete casting base 10 or panel 12 using either of suspended framework 28 or overhead hanging rail system 36. Such components or block-outs may be used to ensure that, during setup, the various holes 13 formed in concrete casting base 10 are aligned to produce a properly sized panel 12 of any shape. Additional hardware may also be used, for example, to elevate and level concrete casting base 10, and thus casting surface 11, relative to a ground surface.

An automated system is also described with reference to the various elements described above. This system may, for example, be used to automate the various movements of each of these elements so as to even further decrease production times. According to one aspect of such a system, each rail 30 may be moveably mounted to concrete casting base 10. One or more actuators may be attached to each rail 30 and concrete casting base 10, each actuator being configured to move a rail 30 and/or an anchor 40 relative to concrete casting base 10. For example, one actuator may be configured to move rail 30 in a direction parallel to casting surface 11, while another actuator is configured to move anchor 40 in a direction perpendicular to casting surface 11. These movements may be controlled by a switch, or by a processing module of the system, which may include or be in communication with any known computing device. However controlled, these actuators may be used within the system to open and close concrete panel form 32 (e.g., by disengaging anchors 40, sliding rails 30, and then reengaging anchors 40), as needed, to produce and remove a panel 12 therefrom. Any of the temperature regulation elements described above may also be controlled by the processing module to both cure panel 12 as fast as possible, and provide an indication as to when panel 12 may be removed. The processing module may also control other hardware (e.g., a crane) to permit removal of panel 12 in an automated sequence.

In some aspects, concrete casting base 10 and/or panel 12 have been described as being poured and/or cured in a substantially horizontal manner (e.g., FIGS. 17-20). This is not required as base casting form 22 and/or concrete panel form 32 may be modified for angular or vertical pouring and/or curing. For example, base casting form 22 may by provided with a second casting skin that defines a sealed volume for receipt of concrete therein. Base 10 may then be formed by pouring concrete into the sealed volume. Form 22 may also be attached (e.g., bolted) to another surface (e.g., a wall) to define the sealed volume. Concrete panel form 32 may be likewise provided with a cover to define a sealed volume for panel 12. Either of these aspects may be used, for example, with an automated system to provide for the top-down pouring of concrete to minimize the need for additional leveling systems. Moreover, it is further noted that the aforementioned elements and processes may be performed with other concrete alternatives or pourable, hardening materials. For example, the aforementioned elements and processes may be performed with lightweight concrete, cellular concrete, fiber reinforced concrete, plastics, resins, and other appropriate materials and/or composites.

While principles of the present disclosure are described herein with reference to illustrative aspects for particular applications, it should be understood that the disclosure is not limited thereto. Those having ordinary skill in the art and access to the teachings provided herein will recognize additional modifications, applications, examples, and substitution of equivalents all fall within the scope of the aspects described herein. Accordingly, the present disclosure is not to be considered as limited by the foregoing description.

We claim:

1. A system, comprising:

a concrete base casting form having a plurality of side walls, a casting surface skin, a frame supporting the plurality of side walls and the casting surface skin, wherein the plurality of side walls and the casting surface skin are removably attached to the frame;

a suspended framework coupled to the plurality of side walls, the suspended framework having a plurality of forming rods extending toward the concrete base casting form;

a concrete base having a casting surface and a plurality of holes extending through a thickness of the concrete base, wherein the concrete base, including the casting surface and the plurality of holes, is formed by pouring a supply of concrete into the concrete base casting form;

a plurality of casting rails forming a closed perimeter on the concrete base with an opening configured to receive additional concrete to form a panel, each casting rail including at least one hole; and a plurality of anchors, wherein the anchors removably attach the plurality of casting rails to the plurality of holes in the concrete base, wherein each casting rail is decoupled from any adjacent casting rail, and individually and removably coupled to and removable from the casting surface of the concrete base by fastening through at least one hole in one of the plurality of casting rails and one of the plurality of holes extending through the thickness of the concrete base, wherein casting rails on a first side and a second side of the panel form each include an extension on an inwardly facing surface extending toward the opening, and wherein casting rails on a third side and a fourth side of the panel form each include an indentation on an inwardly facing surface extending away from the opening, and wherein the extensions on the inwardly facing surface on the first and second sides and the indentations on the inwardly facing surfaces of the third and fourth sides of the panel form correspond to one another such that a portion of a first formed panel includes a portion formed by one or more of the extensions that is configured to receive a portion of a second resulting panel that is formed by one or more of the indentations.

2. The system of claim 1, further including at least one reinforcement or attachment device internal to the closed perimeter on the concrete base.

3. The system of claim 1, further including an overhead hanging rail system that locates at least one suspended engineered embed location, wherein the overhead hanging rail system is removably attached to each casting rail and to the at least one suspended engineered embed location, and wherein the at least one suspended engineered embed location is configured to be coupled to a lifting source to apply a lifting force.

4. The system of claim 1, wherein the plurality of holes in the thickness of the concrete base are threaded, and wherein the anchors are threaded to correspond to the threading of the plurality of holes.

5. The system of claim 4, further comprising a collar around each of the plurality of holes.

6. The system of claim 1, wherein each of the anchors includes a retractable protrusion, wherein each of the plurality of holes in the thickness of the concrete base includes a catch, and wherein the retractable protrusion selectively engages with the catch.

7. The system of claim 1, wherein at least one of the plurality of holes in the thickness of the concrete base is an elongated slot.

8. The system of claim 1, wherein the concrete base further includes a plurality of temperature regulating elements.

9. The system of claim 1, further comprising a cover, and wherein the casting surface, the plurality of casting rails, and the cover define a sealed volume.

10. A system, comprising:

a concrete base casting form having a plurality of side walls, a casting surface skin, and a frame supporting the plurality of side walls and the casting surface skin;

wherein the plurality of side walls and the casting surface skin are removably attached to the frame;

a suspended framework coupled to the plurality of side walls, the suspended framework having a plurality of forming rods extending toward the concrete base casting form;

a supply of concrete to pour into and harden within the concrete base casting form to form a concrete base having a casting surface formed by the casting surface skin and a plurality of holes formed by the plurality of forming rods of the suspended framework;

a plurality of casting rails removably attachable to the casting surface of the formed concrete base, wherein the plurality of casting rails form a concrete panel form configured to receive additional concrete to form a concrete panel, wherein the plurality of casting rails form a closed perimeter on the concrete base with an opening to receive concrete to form the concrete panel;

a plurality of reinforcement members, a plurality of attachment devices, and an overhead hanging rail system, wherein the reinforcement members and the attachment devices are removably coupled to the casting rails via the overhead hanging rail system; and a plurality of anchors, wherein the anchors removably attach the plurality of casting rails to the plurality of holes in the formed concrete base, wherein the concrete base casting form includes a plurality of hollow sections.

11. The system of claim 10, further including reinforcing and/or attachment hardware attachable to the plurality of casting rails.

12. The system of claim 11, wherein the plurality of forming rods of the suspended framework are evenly spaced, wherein the frame is steel, wherein the concrete base casting form includes a plurality of cylindrical hollow sections, wherein casting rails on a first side and a second side of the panel form each include an extension on an inwardly facing surface extending toward the opening, and wherein casting rails on a third side and a fourth side of the panel form each include an indentation on an inwardly facing surface extending away from the opening, and wherein each casting rail is decoupled from any adjacent casting rail, and individually and removably coupled to and removable from the casting surface of the concrete base by fastening through at least one hole in one of the plurality of casting rails and one of the plurality of holes extending through the thickness of the concrete base.

13. The system of claim 10, wherein the concrete base casting form includes a plurality of cylindrical hollow sections.

14. A system, comprising:

a concrete base casting form having a plurality of side walls, a casting surface skin, and a frame supporting the plurality of side walls and the casting surface skin;

wherein the plurality of side walls and the casting surface skin are removably attached to the frame;

a suspended framework coupled to the plurality of side walls, the suspended framework having a plurality of forming rods extending toward the concrete base casting form;

a supply of concrete to pour into and harden within the concrete base casting form to form a concrete base having a casting surface formed by the casting surface skin and a plurality of holes formed by the plurality of forming rods of the suspended framework;

a plurality of casting rails removably attachable to the casting surface of the formed concrete base; and a plurality of anchors, wherein the anchors removably attach the plurality of casting rails to the plurality of holes in the formed concrete base, wherein the plurality of casting rails form a concrete panel form configured to receive additional concrete to form a concrete panel, wherein the plurality of casting rails form a closed perimeter on the concrete base with an opening to receive concrete to form the concrete panel, wherein casting rails on a first side and a second side of the panel form each include an extension on a bottom portion of an inwardly facing surface extending toward the opening, and wherein casting rails on a third side and a fourth side of the panel form each include an indentation on a bottom portion of an inwardly facing surface extending away from the opening, wherein the extensions on the first and second sides each include shapes that correspond to shapes of the indentations on the third and fourth sides to form corresponding shapes in formed panels, and wherein the concrete base casting form includes a plurality of cylindrical hollow sections.

15. The system of claim 14, wherein the concrete base further includes a plurality of temperature regulating elements.

16. The system of claim 14, further comprising a cover, and wherein the casting surface, the plurality of casting rails, and the cover define a sealed volume.

17. The system of claim 14, wherein the plurality of holes in the thickness of the concrete base are threaded, wherein the anchors are threaded to correspond to the threading of the plurality of holes, and further comprising a collar around each of the plurality of holes.

18. The system of claim 14, further including reinforcing and/or attachment hardware attachable to the plurality of casting rails.

19. The system of claim 14, further comprising a plurality of reinforcement members, a plurality of attachment devices, and an overhead hanging rail system, wherein the reinforcement members and the attachment devices are removably coupled to the casting rails via the overhead hanging rail system, and wherein each casting rail is decoupled from any adjacent casting rail, and individually and removably coupled to and removable from the casting surface of the concrete base by fastening through at least one hole in one of the plurality of casting rails and one of the plurality of holes extending through the thickness of the concrete base.

* * * * *